US011155095B2

(12) United States Patent
Nishisaka et al.

(10) Patent No.: US 11,155,095 B2
(45) Date of Patent: Oct. 26, 2021

(54) INKJET RECORDING APPARATUS AND CLEANING METHOD OF INTERMEDIATE TRANSFER BODY

(71) Applicant: Konica Minolta, Inc., Tokyo (JP)

(72) Inventors: Yusuke Nishisaka, Mitaka (JP); Hajime Kawakami, Hino (JP); Mei Suzuki, Toyokawa (JP); Keishi Suzuki, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/799,988

(22) Filed: Feb. 25, 2020

(65) Prior Publication Data

US 2020/0276820 A1 Sep. 3, 2020

(30) Foreign Application Priority Data

Feb. 28, 2019 (JP) ..... JP2019-036497

(51) Int. Cl.

| | |
|---|---|
| ***B41J 2/165*** | (2006.01) |
| ***B41J 11/00*** | (2006.01) |
| ***B41J 29/17*** | (2006.01) |
| *B41J 2/01* | (2006.01) |

(52) U.S. Cl.

CPC ..... *B41J 2/16552* (2013.01); *B41J 2/16579* (2013.01); *B41J 11/002* (2013.01); *B41J 29/17* (2013.01); *B41J 2002/012* (2013.01)

(58) Field of Classification Search

CPC ..... B41J 29/17; B41J 2/16579; B41J 11/002; B41J 2/01; B41J 2002/012

See application file for complete search history.

(56) References Cited

U.S. PATENT DOCUMENTS

| | | | | |
|---|---|---|---|---|
| 8,025,388 | B2 * | 9/2011 | Kadomatsu | B41J 2/0057 347/103 |
| 9,533,491 | B1 * | 1/2017 | LeFevre | B41J 2/16517 |
| 2012/0262525 | A1 * | 10/2012 | Ohnishi | B41F 23/04 347/102 |
| 2014/0068329 | A1 * | 3/2014 | Hopper | G06F 11/0709 714/25 |

FOREIGN PATENT DOCUMENTS

JP 2009072928 A 4/2009

* cited by examiner

*Primary Examiner* — Sharon Polk

(74) *Attorney, Agent, or Firm* — Cantor Colburn LLP

(57) ABSTRACT

An inkjet recording apparatus includes an ink jetter; a transfer unit that has an intermediate transfer body and transfers ink on its transfer surface to a recording medium to record an image; a thickening device that thickens the ink landed on the transfer surface before transfer to the recording medium; a cleaner that removes residual ink remaining on the transfer surface; and a hardware processor. The cleaner has a first ink remover that removes the thickened residual ink in first ink removing operation in which an adhesive member brought into contact with the thickened ink is separated from the transfer surface. If the transfer surface has a region occupied by the thickened ink of a predetermined reference area or more, the hardware processor causes the first ink remover to perform the first ink removing operation.

19 Claims, 13 Drawing Sheets

*FIG.4*

| | NON-THICKENED INK | THICKENED INK | |
|---|---|---|---|
| | | DOT INK (AREA OF THICKENED INK > REFERENCE AREA) | SOLID INK (AREA OF THICKENED INK ≤ REFERENCE AREA) |
| ADHESIVE MEMBER | CC | BB | AA |
| SCRAPER | BB | AA | BB |
| WIPER | AA | CC | CC |

INKJET RECORDING APPARATUS AND CLEANING METHOD OF INTERMEDIATE TRANSFER BODY

CROSS-REFERENCE TO RELATED APPLICATIONS

The present invention claims priority under 35 U.S.C. § 119 to Japanese Patent Application No. 2019-036497 filed on Feb. 28, 2019, the entire contents of which are incorporated herein by reference.

BACKGROUND

Technological Field

The present invention relates to an inkjet recording apparatus and a cleaning method of an intermediate transfer body.

Description of the Related Art

Conventionally, there is an inkjet recording apparatus which jets ink from an ink jetter such that the ink lands on a predetermined transfer surface of an intermediate transfer body and forms a primary image. The inkjet recording apparatus transfers the primary image onto a recording medium and forms an image thereon. Regarding such an inkjet recording apparatus, there is known a technique of suitably increasing viscosity of ink having landed on the transfer surface (for example, irradiation of ultraviolet curable ink with ultraviolet rays for provisional curing) so that the ink is easily peeled from the transfer surface and transferred to the recording medium.

However, even in using such a technique, a part of the ink usually remains on the transfer surface without being transferred to the recording medium. The residual ink on the transfer surface needs to be removed regularly or at a predetermined timing. In order to effectively remove the residual ink, according to a method disclosed in JP 2009-72928 A, for example, an operation is performed over the entire transfer surface so as to bring an adhesive member having adhesive force into contact with the transfer surface, and the adhesive member is thereafter peeled off together with the residual ink from the transfer surface.

SUMMARY

However, when the adhesive member is uniformly brought into contact with the entire transfer surface, the adhesive member also comes into contact with a region which the adhesive member does not have to clean. For this reason, the adhesive member loses adhesive force immediately, which results in reduced cleaning efficiency of the transfer surface. Furthermore, since the adhesive member is brought into contact with and peeled off from the transfer surface continuously in the above method, the peeled adhering things easily drops from the surface of the adhesive member and stains the transfer surface, which also results in reduced cleaning efficiency of the transfer surface.

In this way, according to above conventional techniques, there is a problem that the transfer surface is difficult to be efficiently and effectively cleaned.

An object of the present invention is to provide an inkjet recording apparatus and a cleaning method of an intermediate transfer body having a transfer surface that can be cleaned efficiently and effectively.

In order to achieve at least one of the abovementioned objects, according to a first aspect of the present invention, there is provided an inkjet recording apparatus including: an ink jetter that jets ink; a transfer unit that has an intermediate transfer body having a transfer surface on which ink jetted by the ink jetter lands and forms a primary image, transfers the ink on the transfer surface to a recording medium, and records an image on the recording medium; a thickening device that performs thickening operation in which viscosity of the ink landed on the transfer surface is increased before transferred to the recording medium; a cleaner that removes residual ink from the transfer surface, the residual ink remaining on the transfer surface without being transferred to a recording medium; and a hardware processor. The cleaner has a first ink remover that removes thickened ink from the transfer surface in first ink removing operation in which an adhesive member having an adhesive force brought into contact with the thickened ink is separated from the transfer surface, the thickened ink being the residual ink whose viscosity has been increased in the thickening operation. If the transfer surface has a thickened-ink-covered region that is a region occupied by the thickened ink and that has an area of a predetermined reference area or more, the hardware processor causes the first ink remover to perform the first ink removing operation.

According to a second aspect of the present invention, there is provided a cleaning method of an intermediate transfer body in an inkjet recording apparatus. The inkjet recording apparatus includes: an ink jetter that jets ink; a transfer unit that has an intermediate transfer body having a transfer surface on which ink jetted by the ink jetter lands and forms a primary image, transfers the ink on the transfer surface to a recording medium, and records an image on the recording medium; a thickening device that performs thickening operation in which viscosity of the ink landed on the transfer surface is increased before transferred to the recording medium; and a cleaner that removes residual ink from the transfer surface, the residual ink remaining on the transfer surface without being transferred to a recording medium. The cleaner has a first ink remover that removes thickened ink from the transfer surface in first ink removing operation in which an adhesive member having an adhesive force brought into contact with the thickened ink is separated from the transfer surface, the thickened ink being the residual ink whose viscosity has been increased in the thickening operation. The cleaning method includes, if the transfer surface has a thickened-ink-covered region that is a region occupied by the thickened ink and that has an area of a predetermined reference area or more, causing the first ink remover to perform the first ink removing operation.

BRIEF DESCRIPTION OF THE DRAWINGS

The advantages and features provided by one or more embodiments of the invention will become more fully understood from the detailed description given hereinbelow and the appended drawings which are given by way of illustration only, and thus are no intended as a definition of the limits of the present invention, wherein:

FIG. 4 is a diagram illustrating a cleaning effect with an adhesive member, a scraper, and a wiper for each ink state;

DETAILED DESCRIPTION OF THE EMBODIMENTS

Hereinafter, one or more embodiments according to an inkjet recording apparatus and a cleaning method of the intermediate transfer body according to the present invention will be described with reference to the drawings. However, the scope of the invention is not limited to the disclosed embodiments.

<Configuration of Inkjet Recording Apparatus>

Figure 1:
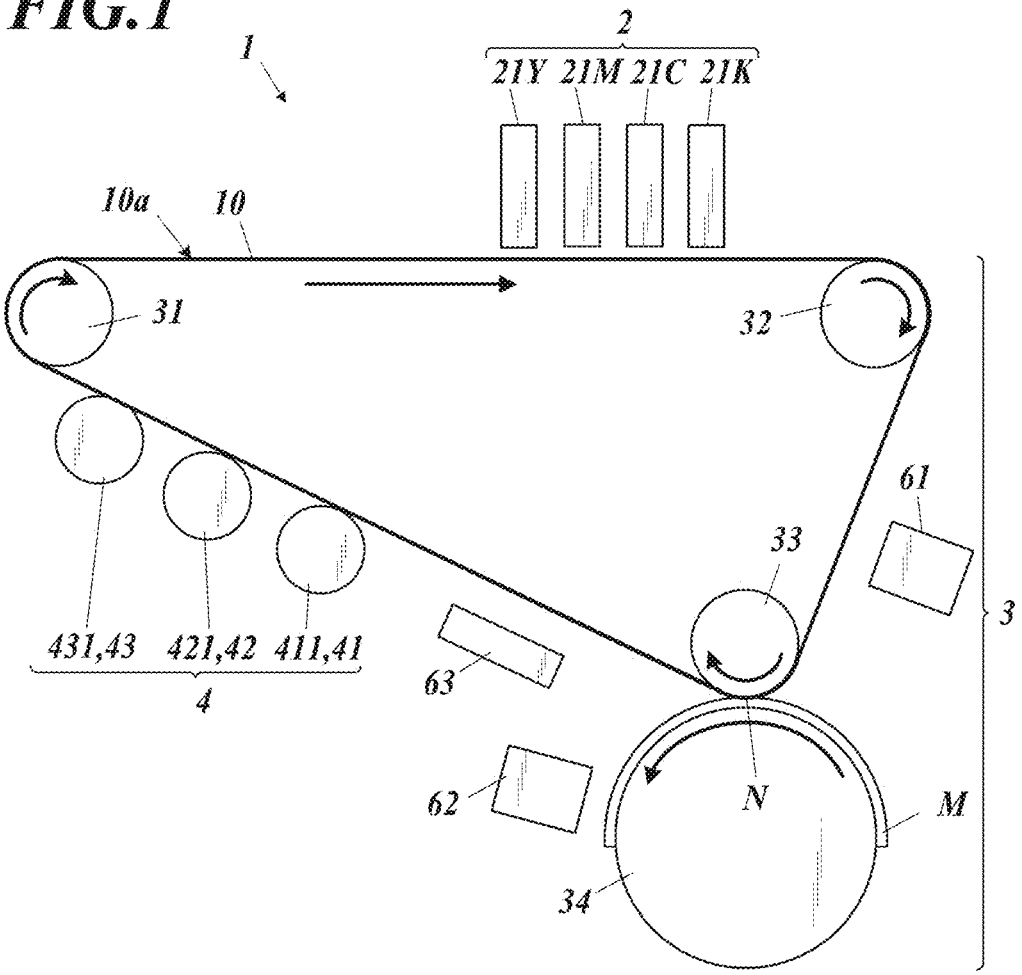
FIG. 1 is a diagram showing schematic configuration of an inkjet recording apparatus.

FIG. 1 shows schematic configuration of an inkjet recording apparatus 1.

Figure 3:
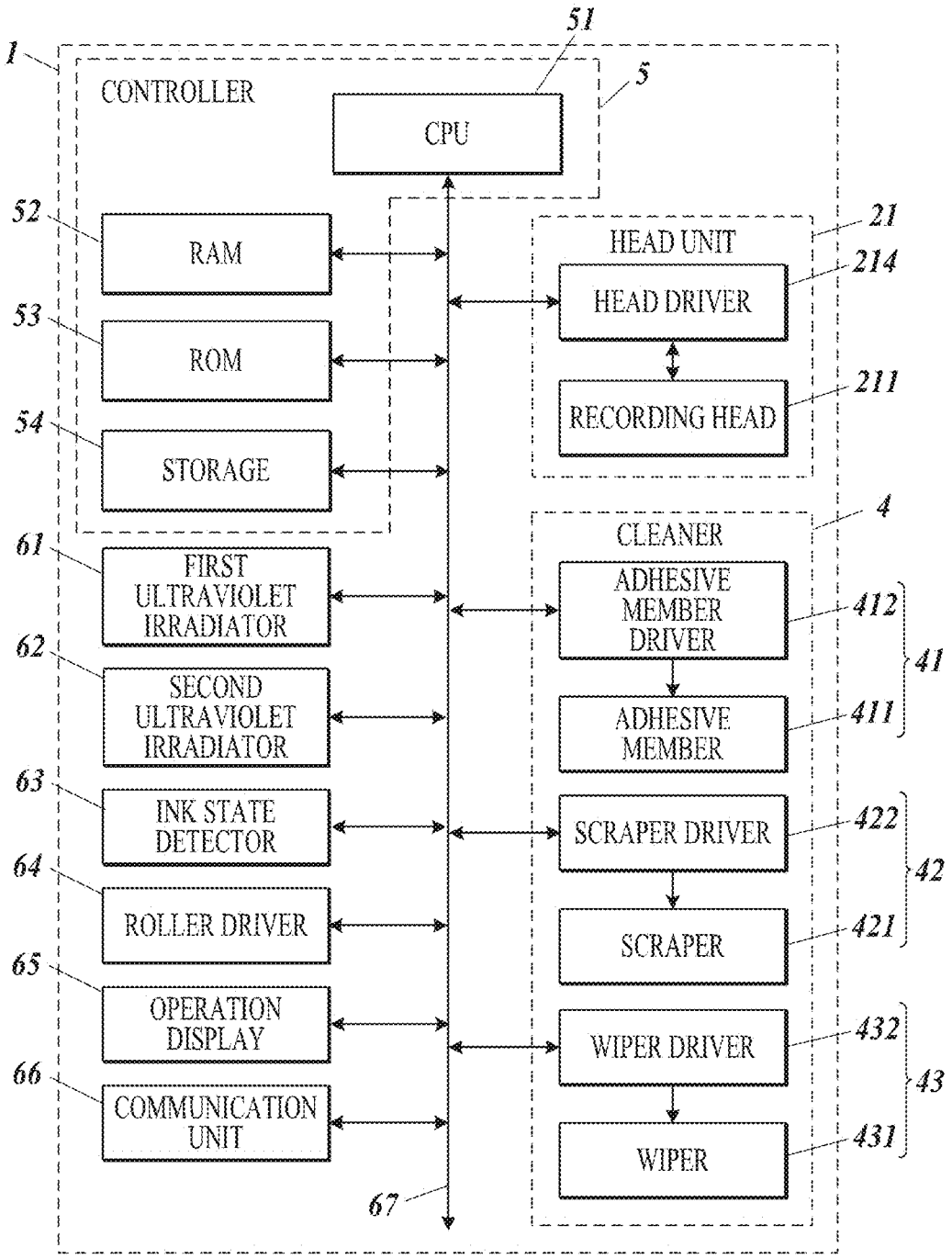
FIG. 3 is a block diagram showing functional configuration of the inkjet recording apparatus.

The inkjet recording apparatus 1 includes an ink jetter 2, a transfer unit 3, a cleaner 4, a first ultraviolet irradiator 61 (a thickening device), a second ultraviolet irradiator 62, an ink state detector 63 (detector), a controller 5 (hardware processor), and the like (see FIG. 3). The inkjet recording apparatus 1 jets ink from the ink jetter 2 to an intermediate transfer body 10, forms a primary image on the outer peripheral surface (hereinafter also called a transfer surface 10*a*) of the intermediate transfer body 10, and transfers the ink forming the primary image to a recording medium M so as to record an image on the recording medium M. Examples of the recording medium M may be selected from various media such as paper, resin plate, metal, cloth, rubber, and the like. Examples of the paper may be selected from plain paper, paperboard, coated paper, resin-coated paper, synthetic paper, and the like.

The ink jetter 2 jets ink from nozzles to the transfer surface 10*a* of the intermediate transfer body 10 on the basis of image data, thereby forms a primary image on the transfer surface 10*a*. The ink jetter 2 has head units for respective colors; here, four head units 21Y, 21M, 21C, and 21K for colors of yellow (Y), magenta (M), cyan (C), and black (K), respectively (hereinafter, each of these head units may be called a head unit 21). Head units 21 have respective ink jetting surfaces. The ink jetting surfaces are arranged so as to face the transfer surface 10*a* of the intermediate transfer body 10 at appropriate intervals. The number of the head units 21 may be more than or less than four.

Figure 2:
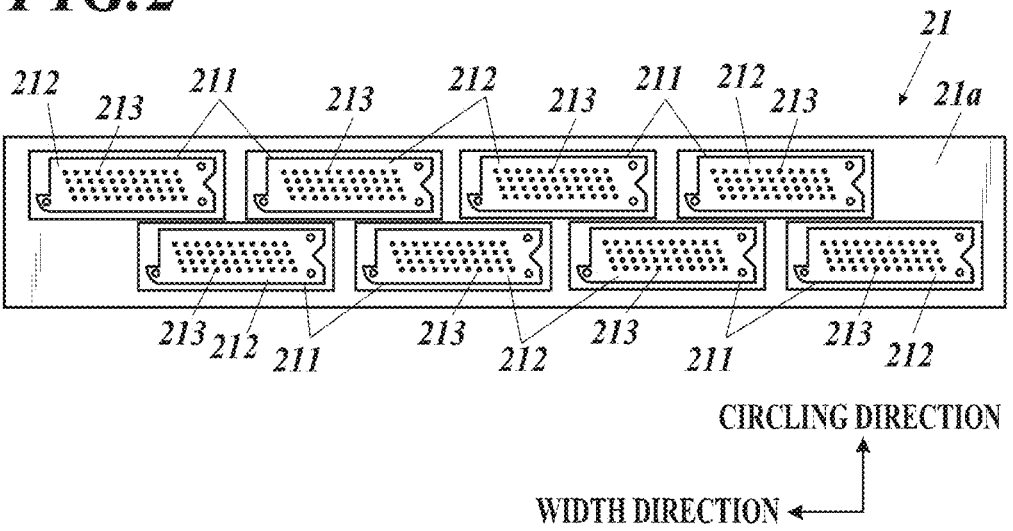
FIG. 2 is a schematic view showing configuration of a head unit.

FIG. 2 is a schematic plan view showing configuration of the head unit 21 seen from a side of the transfer surface 10*a* of the intermediate transfer body 10. The head unit 21 has a plate-shaped support 21*a* and multiple (here, eight) recording heads 211 each fitted in a through hole formed in the support 21*a* and fixed to the support 21*a*. The recording heads 211 are fixed to the support 21*a* such that respective jetting surfaces 212 are each provided with openings of nozzles 213 exposing toward the transfer surface 10*a* from the through holes of the support 21*a*.

Each of the recording heads 211 has the nozzles 213 arranged at regular intervals in a direction (hereinafter, a width direction) crossing a traveling direction of the intermediate transfer body 10 moving around rollers (hereinafter, the travelling direction may be called a circling direction). In this embodiment, the width direction is perpendicular to the circling direction. In this embodiment, each of the recording heads 211 has four nozzle lines in each of which the nozzles 213 are arranged straight at regular intervals in the width direction. Positions of the four nozzle lines in the width direction are different from each other such that the positions of the respective nozzles 213 in the width direction do not coincide with each other. The number of the nozzle lines in each of the recording heads 211 is not limited to four, but may be more than or less than four.

The eight recording heads 211 of the head unit 21 are arranged to be staggered such that the nozzles 213 are arranged continuously in the width direction. The range of the continuously arranged nozzles 213 in the respective recording heads 211 encompasses the range in the width direction of a region where a primary image can be formed on the transfer surface 10*a* of the intermediate transfer body 10. In forming a primary image, the head unit 21 is used with its position fixed and, according to the circling movement of the intermediate transfer body 10, jets ink from the nozzles 213 to positions on the intermediate transfer body 31 at predetermined intervals in the circling direction, and thereby forms the primary image with a single-pass system. The ink may be jetted from the nozzles 213 using an ink jetting mechanism of a piezo type where piezoelectric elements are used or of a thermal type where ink is heated and then gushed out.

The ink to be jetted from the nozzles of the head unit 21 has viscosity that increases in response to energy application by a predetermined method (hereinafter, the increase of viscosity is also called thickening). The ink used in this embodiment is photocurable ink (ultraviolet curable ink in this embodiment) having viscosity that increases as the curing reaction proceeds in response to irradiation with light (first light). The spectrum of the first light (in this embodiment, ultraviolet ray) has a peak within a predetermined wavelength range.

Easy transferability of ink can be improved when ultraviolet curable ink is used, since viscosity of the ink can be increased to some extent by appropriate irradiation of the ink landing on the transfer surface 10*a* of the intermediate transfer body 10 with ultraviolet rays.

The ink used in this embodiment is phase-change ink whose phase changes between gel and sol depending on temperature. The heated ink having become sol is jetted from the nozzles 213 of the head unit 21, lands on the transfer surface 10*a* of the intermediate transfer body 10, and swiftly becomes gel when being cooled. The viscosity of the ink having become gel is adjusted by ultraviolet irradiation.

The ink used in this embodiment contains a photopolymerizable compound (monomer), a photoinitiator, a gelling agent, and a coloring agent. The photopolymerizable compound is polymerized in response to ultraviolet irradiation and forms a polymer. The ink is thickened and cured as a result of such polymerization. The photoinitiator is a compound for initiating the above polymerization. The gelling agent is a compound having a property of making the ink sol by dissolving in ink when the ink is heated to a solating temperature or more, and a property of making the ink gel by forming a crosslinked structure or a fibrous aggregate when the ink is cooled to a gelling temperature or less. The coloring agent contains a pigment or a dye according to the color of the ink.

In the transfer unit 3 in FIG. 0.1, the intermediate transfer body 10 and a recording medium M fed from a paper feeder (not illustrated) are moved to be in contact with each other, such that a primary image formed on the intermediate transfer body 10 is transferred to the recording medium M. The transfer unit 3 includes the intermediate transfer body 10, a driving roller 31, a driven roller 32, a pressing roller 33, a conveying roller 34, and the like.

The intermediate transfer body 10 is an endless (ring-shaped) belt having the transfer surface 10*a* on which ink jetted by the ink jetter 2 lands. On the transfer surface 10*a* of the intermediate transfer body 10, a primary image is formed with the ink having landed thereon, and is transferred to a recording medium M. The intermediate transfer body 10 is stretched around the driving roller 31, the driven roller 32, and the pressing roller 33, and moves around as the driving roller 31 rotates, such that the transfer surface 10*a* moves around along a predetermined circuit. Although not illustrated, a supporting member having a flat surface supports the intermediate transfer body 10 at least at a portion facing the ink jetter 2 to form a horizontal plane thereof.

The viscosity of the ink on the transfer surface 10*a* of the intermediate transfer body 10 increases to some extent when irradiated with ultraviolet rays from the first ultraviolet irradiator 61. Hereinafter, the step of increasing viscosity of the ink on the intermediate transfer body 10 before transfer may be also referred to as "provisional curing".

The driving roller 31 rotates on its shaft depending on drive of a motor (not illustrated). The driven roller 32 is arranged at a certain distance away from the driving roller 31, and rotates on its shaft parallel to the shaft of the driving roller 31 depending on the circling movement of the intermediate transfer body 10.

The intermediate transfer body 10 is stretched on the pressing roller 33. The pressing roller 33 may be movable so as to correct sags of the intermediate transfer body 10.

The conveying roller 34 rotates and conveys, in its rotating direction, the recording medium M which is fed from a paper feeder (not illustrated) and held on the outer peripheral surface. The conveying roller 34 is arranged to form a nip N with the pressing roller 33. The intermediate transfer body 10 and the recording medium M are inserted into and pressed by the nip N. As a result, ink on the transfer surface 10*a* of the intermediate transfer body 10 (primary image) is transferred to the recording medium M so that an image is recorded on the recording medium M.

The recording medium M may be conveyed not while being held on the outer peripheral surface of the conveying roller 34, but while being directly inserted into the nip N between the pressure roller 33 and the conveying roller 34 (horizontally from the right side of FIG. 1).

The first ultraviolet irradiator 61 is arranged facing the transfer surface 10*a* of the intermediate transfer body 10 at a range between the driven roller 32 and the pressure roller 33. In other words, the first ultraviolet irradiator 61 is arranged facing the intermediate transfer body 10 at a portion immediately before entering the nip N. The first ultraviolet irradiator 61 irradiates the ink on the transfer surface 10*a* of the intermediate transfer body 10 with ultraviolet rays, thereby increasing the viscosity of the ink and provisionally curing the ink. More specifically, the first ultraviolet irradiator 61 irradiates the transfer surface 10*a* with ultraviolet rays whose intensity and irradiation time are set such that the viscosity of the ink measured by a rheometer is $1\times10^4$ Pa·s ($1\times10^7$ cP) or more. This ultraviolet irradiation by the first ultraviolet irradiator 61 is thickening operation.

The controller 5 switchably controls the first ultraviolet irradiator 61 whether or not to perform the thickening operation of ink on the transfer surface 10*a* which moves relative to and faces the first ultraviolet irradiator 61. That is, the first ultraviolet irradiator 61 can stop ultraviolet irradiation at any timing.

The second ultraviolet irradiator 62 is arranged facing the outer peripheral surface of the conveying roller 34 at a position on the downstream side of the nip N in a conveyance direction of the recording medium M by the conveying roller 34. The controller 5 controls the second ultraviolet irradiator 62 to irradiate the surface of the recording medium M on the conveying roller 34 with ultraviolet rays of a predetermined intensity, over the entire width of the recording medium M. The ultraviolet irradiation by the second ultraviolet irradiator 62 makes the ink transferred to the recording medium M to be completely cured and fixed onto the surface of the recording medium M with an anchor effect. Hereinafter, the step of curing ink with the second ultraviolet irradiator 62 may be also referred to as "main curing."

The recording medium M having passed through the second ultraviolet irradiator 62 is taken apart from the outer peripheral surface of the conveying roller 34 and conveyed to a predetermined sheet ejector (not illustrated).

The ink state detector 63 is arranged facing the transfer surface 10*a*, at a position between the nip N and the driving roller 31 in the circling direction of the intermediate transfer body 10. The ink state detector 63 includes an in-line sensor which captures an image of the surface of the transfer surface 10*a* and a thickening detector which detects a thickening state of the ink on the transfer surface 10*a*.

The in-line sensor captures an image of the transfer surface 10*a* and ink thereon (residual ink remaining on the transfer surface 10*a* without being transferred to the recording medium M) with a plurality of capturing elements arranged in the width direction, and outputs the capturing result to the controller 5. Instead of the in-line sensor, another sensor that can detect ink on the transfer surface 10*a*, such as an IDC (Image Density Control) sensor, may be used.

The thickening detector irradiates the residual ink on the transfer surface 10*a* with ultraviolet rays, detects fluorescence of the ink in response to the ultraviolet irradiation, detects the thickening state (curing rate) of the residual ink on the basis of the fluorescence detection result, and outputs the thickening state (curing rate) to the controller 5. Otherwise, the thickening detector may output the fluorescence detection result to the controller 5, and the controller 5 may specify the thickening state of the residual ink on the basis of the detection result.

The cleaner 4 is arranged facing the transfer surface 10*a*, at a position between the ink state detector 63 and the driving roller 31 in the circling direction of the intermediate transfer body 10. The cleaner 4 cleans the transfer surface 10*a* by removing the residual ink remaining on the transfer surface 10*a* without being transferred to the recording medium M. The cleaner 4 includes a first ink remover 41 having an adhesive member 411, a second ink remover 42 having a scraper 421, and a third ink remover 43 having a wiper 431.

The first ink remover 41 performs a first ink removing operation where residual ink having increased viscosity (hereinafter referred to as thickened ink) because of the provisional curing is removed from the transfer surface 10*a*, by bringing the adhesive member 411 into contact with the transfer surface 10*a* and the residual ink on the transfer surface 10*a*, and separating (peeling) the adhesive member 411 from the transfer surface 10*a*.

The adhesive member 411 of the first ink remover 41 is a roller having an outer peripheral surface in which the entire surface to be in contact with the transfer surface 10*a* has adhesive force, and is arranged with its rotation shaft to be parallel to the width direction. For example, the adhesive member 411 may be formed by winding an adhesive body such as an adhesive sheet around the outer peripheral surface of a columnar member. The material of the adhesive body is not particularly limited, and may be resin having adhesiveness such as butyl rubber or urethane rubber.

The adhesive member 411 is movably provided between a contact position and a retracted position. While the outer peripheral surface of the adhesive member 411 is in contact with the transfer surface 10*a* at the contact position, it is not in contact with the transfer surface 10*a* at the retracted position. The adhesive member 411 at the contact position rotates on the rotation shaft as the transfer surface 10*a* moves in the circling direction, depending on frictional force between the transfer surface 10*a* and the outer peripheral surface. Furthermore, as the adhesive member 411 rotates, the adhesive body on the outer peripheral surface is peeled off from the transfer surface 10*a* with the residual ink on the transfer surface 10*a* is sticking to the outer peripheral surface. Thus, the residual ink is removed from the transfer surface 10*a*, and the surface of the transfer surface 10*a* is cleaned.

The second ink remover 42 is provided on the downstream side of the first ink remover 41 in the circling direction of the intermediate transfer body 10 (moving direction of the transfer surface 10*a*). The second ink remover 42 performs a second ink removing operation where residual ink is removed from the transfer surface 10*a* by scraping the transfer surface 10*a* and the residual ink the transfer surface 10*a* with the scraper 421.

The scraper 421 of the second ink remover 42 is a roller having a member with many protrusions (for example, a brush) on the outer peripheral surface, and has a rotation shaft parallel to the width direction. The material with many protrusions on the outer peripheral surface of the scraper 421 is not particularly limited, but may be selected from various resins and fibers, as long as it is not so hard as to damage the transfer surface 10*a* when brought into contact with and scraping the transfer surface 10*a* but enough hard to remove the thickened residual ink by the provisional curing on the transfer surface 10*a*.

The scraper 421 is movably provided between a contact position and a retracted position. While the outer peripheral surface of the scraper 421 is in contact with the transfer surface 10*a*, and at the contact position, it is not in contact with the transfer surface 10*a* at the retracted position. The scraper 421 at the contact position rotates such that the rotation speed of its outer peripheral surface is different from the moving speed of the transfer surface 10*a* (for example, rotates in a direction opposite to the moving direction of the transfer surface 10*a*), to peel off and remove residual ink on the transfer surface 10*a*. The scraper 421 thereby cleans the surface of the transfer surface 10*a*.

Furthermore, the scraper 421 also removes the adhesive body peeled off and dropped from the surface of the adhesive member 411. Therefore, the scraper 421 is desirably provided on the downstream side of the adhesive member 411 in the circumferential movement direction.

In addition, the scraper 421 may soaked with a liquid including a surfactant in order to reduce friction with the transfer surface 10*a* or to easily remove ink. In this case, the wiper 431 desirably performs wiping on the downstream side of the scraper 421.

The third ink remover 43 is provided on the downstream side of the second ink remover 42 in the circling direction of the intermediate transfer body 10. The third ink remover 43 performs a second ink removing operation where residual ink, in particular, one having viscosity not increased by the provisional curing (hereinafter referred to as non-thickened ink), is wiped.

The wiper 431 of the third ink remover 43 is a roller whose outer peripheral surface is provided with an absorbing member that can absorb unthickened ink and whose rotation shaft is parallel to the width direction. The absorbing member on the outer peripheral surface of the wiper 431 is not particularly limited. A sponge, a fabric, a porous member made of a polyolefin resin, and the like may be used.

The wiper 431 is movably provided between a contact position and a retracted position. While the outer peripheral surface of the wiper 431 is in contact with the transfer surface 10*a* at the contact position, it is not in contact with the transfer surface 10*a* at the retracted position. If there remains residual ink on the transfer surface 10*a*, the wiper 431 wipes off and removes the residual ink, and cleans the transfer surface 10*a*. That is, the wiper 431 at the contact position rotates such that the rotation speed of its outer peripheral surface is different from the moving speed of the transfer surface 10*a* (for example, rotates in a direction opposite to the moving direction of the transfer surface 10*a*), and absorbs and removes the residual ink by the absorbing member on the surface. If the absorbing member has sufficient absorbency, the outer peripheral surface may rotate following the transfer surface 10*a* by the frictional force with the transfer surface 10*a*.

FIG. 3 is a block diagram showing functional configuration of the inkjet recording apparatus 1.

The inkjet recording apparatus 1 includes: the controller 5; the head unit 21 having a head driver 214 and a recording head 211; the cleaner 4 having the first ink remover 41, the second ink remover 42, and the third ink remover 43; the above-described first ultraviolet irradiator 61, the second ultraviolet irradiator 62, and the ink state detector 63; a roller driver 64 (a mover); an operation display 65; the communication unit 66; the bus 67; and the like. The first ink remover 41 includes the adhesive member 411 and an adhesive member driver 412 that drives the adhesive member 411, the second ink remover 42 includes the scraper 421 and a scraper driver 422 that drives the scraper 421, and the third ink remover 43 includes the wiper 431 and a wiper driver 432 that drives the wiper 431.

The controller 5 is a hardware processor that integrally controls operation of the inkjet recording apparatus 1. The controller 5 includes a central processing unit (CPU) 51, a random access memory (RAM) 52, a read only memory (ROM) 53, a storage 54, and the like.

The CPU 51 reads out programs for various kinds of control and setting data that are stored in the ROM 53, causes the RAM 52 to store the read ones, and performs various kinds of arithmetic processing by executing the programs.

The RAM 52 provides the CPU 51 with a memory space for work, and stores temporary data. The RAM 52 may include a nonvolatile memory.

The ROM 53 stores the programs for various kinds of control, which are executed by the CPU 51, the setting data, and so forth. Instead of the ROM 53, a rewritable nonvolatile memory, such as a flash memory, may be used.

The storage 54 stores image data to be recorded, job data including operation settings related to recording operation of the image data, and the like that are input from an external apparatus via the communication unit 66. As the storage 54, for example, a hard disk drive (HDD) is used, or a dynamic random access memory (DRAM) may be jointly used.

The head driver 214 outputs, in accordance with control signals from the controller 5, image data and/or control signals to the recording head 211 at appropriate timings according to the circling movement of the intermediate transfer body 10, thereby causing the recording head 211 to jet ink from the nozzles 213.

The adhesive member driver 412 moves the adhesive member 411 between the contact position and the retracted position in accordance with control signals from the controller 5.

The scraper driver 422 moves the scraper 421 between the contact position and the retracted position and causes the scraper 421 to rotate at a predetermined rotation speed, in accordance with control signals from the controller 5.

The wiper driver 432 moves the wiper 431 between the contact position and the retracted position and causes the wiper 431 to rotate at a predetermined rotation speed, in accordance with control signals from the controller 5.

The roller driver 64 outputs, in accordance with control signals input by the controller 5, driving signals that causes the motor, which rotates the driving roller 31, to perform rotation operation at a predetermined rotation speed, thereby causing the intermediate transfer body 10 to circle at a predetermined speed.

The operation display unit 65 includes a display, such as a liquid crystal display and an organic electroluminescent display, and an input unit with operation keys and/or a touchscreen arranged over the screen of the display. The operation display unit 65 displays various kinds of information on the display, and also converts input operation to the input unit performed by a user to operation signals, and outputs the operation signals to the controller 5.

The communication unit 66 communicates with an external apparatus(es) and exchanges information. The communication unit 66 controls communication in accordance with various communication standards regarding wired or wireless communication on a LAN. Data received by the communication unit 66 include the job data described above. Data sent by the communication unit 66 includes status information related to the progress of the image recording operation in accordance with the job data.

The bus 67 is a signal channel for the controller 5 and the other components to exchange signals.

<Cleaning Operation>

Next, cleaning operation of the intermediate transfer body 10 by the cleaner 4 will be described.

As described above, ink cleaning methods are different between the adhesive member 411, the scraper 421, and the wiper 431 of the cleaning unit 4, in the point of the state of ink that can be removed effectively. In the cleaner 4 of the present embodiment, a member that can effectively remove ink is appropriately selected from the adhesive member 411, the scraper 421, and the wiper 431, according to the ink state, such that the transfer surface 10*a* can be effectively cleaned.

FIG. 4 is a shows cleaning effects with the adhesive member 411, the scraper 421, and the wiper 431 for each ink state.

In FIG. 4, cleaning effects with the respective members are shown for non-thickened ink and for thickened ink. For the thickened ink on the transfer surface 10*a*, the cleaning effects are shown further separately for an integrated portion (connected portion) having area equal to or more than reference area, and for a portion having area less than the reference area. In the present embodiment, the reference area may be equal to area of a circle having a diameter of 1 mm, for example. Hereinafter, thickened ink is also described as "solid ink" when it forms the integrated portion having area equal to or more than reference area, and as "dot ink" when it forms a portion having area less than the reference area. On the transfer surface 10*a*, a region where the solid ink is present (that is, a region having area equal to or more than the reference area and occupied by the thickened ink) is also referred to as a "thickened-ink-covered region."

In FIG. 4, "AA" indicates that the corresponding member has a high cleaning effect for ink in the corresponding state, "BB" indicates that the corresponding member has a moderate but not very high cleaning effect for ink in the corresponding state, and "CC" indicates that the corresponding member hardly hays a cleaning effect for ink in the corresponding state.

The adhesive member 411 exhibits a high cleaning effect of "AA" when ink is the solid ink. This is because the solid ink having large area and being flat easily sticks to the adhesive member 411 by being into contact with the outer peripheral surface of the adhesive member 411 of large area.

The adhesive member 411 exhibits a cleaning effect of "BB" when ink is the dot ink, lower effect than when ink is the solid ink. This is because the dot ink having less area on the transfer surface 10*a* does not stick to the adhesive member 411 easily by being into contact with the outer peripheral surface of the adhesive member 411 of small area.

The adhesive member 411 exhibits an insufficient cleaning effect of "CC" when ink is not thickened. This is because the non-thickened ink having high fluidity does not easily stick to the adhesive member 411. Furthermore, when the non-thickened ink comes into contact with the surface of the adhesive member 411, the adhesive force at the contact portion is lost. As a result, the adhesive member 411 is required to be cleaned or replaced, which is a recovery process that takes a long time. For this reason, the adhesive member 411 is desirably not in contact with the non-thickened ink.

The scraper 421 exhibits a high cleaning effect of "AA" when ink is the dot ink. This is because, when coming into contact with and affected by the protrusions on the surface of the scraper 421, the fine dot ink is easily peeled from the transfer surface 10*a*.

The scraper 421 exhibits a cleaning effect of "BB" when ink is the solid ink, lower effect than when the ink is the dot ink. This is because, even when coming into contact with the protrusions on the surface of the scraper 421, the solid ink is not so affected as to be peeled from the transfer surface 10*a*.

The scraper 421 also exhibits a cleaning effect of "BB" when ink is not thickened, lower effect than when the ink is the dot ink. This is because, even when coming into contact with the protrusions on the surface of the scraper 421, the non-thickened ink having high fluidity is not easily removed from the transfer surface 10*a* due to insufficient stress applied by the scraper 421.

The wiper 431 exhibits a high cleaning effect of "AA" when the ink is not thickened. This is because the wiper 431 having liquid absorbency can effectively remove ink from the transfer surface 10*a* by absorbing the non-thickened ink having high fluidity and.

The wiper 431 exhibits an insufficient cleaning effect of "CC" when ink is thickened, regardless of whether it is the dot ink or the solid ink. This is because the wiper 431 cannot absorb the thickened ink or, even when it does, wipe off the thickened ink well enough to peel it from the transfer surface 10*a*.

The cleaning effects by respective members shown in FIG. 4 indicate that, if the adhesive member 411 and the scraper 421 are properly used depending on area of the residual ink, the transfer surface 10*a* can be effectively cleaned when the residual ink is thickened ink. That is, thickened residual ink can be effectively removed from the transfer surface 21*a* as follows: the adhesive member 411 cleans the region where the solid ink is present (thickened-ink-covered region); and the scraper 421 cleans the region where the solid ink is not present but the dot ink is present.

When the residual ink is non-thickened ink, the wiper 431 can effectively perform the cleaning operation.

It is possible to determine whether or not the residual ink is thickened and to determine the region occupied by the thickened residual ink using the following two methods, for example.

According to the first method, the thickened state of the residual ink is determined on the basis of whether or not the thickening operation (that is, ultraviolet irradiation) is made while the ink on the transfer surface 10*a* is facing the first ultraviolet irradiator 61.

According to the second method, the thickening detector of the ink state detector 63 directly detects the thickened state of the ink. Preferably, according to the second method, the thickening detector is set to detect thickened ink when the viscosity of the ink is $1\times10^4$ Pa·s or more.

The area of residual ink (thickened ink) can be determined according to the following two methods, for example.

According to the first method, the area is estimated on the basis of the amount of ink jetted from the head unit 21 onto the transfer surface 10*a*. Usually, a substantially constant proportion of the ink landed on the transfer surface 10*a* is considered to remain without being transferred to the recording medium M. Under such an estimation, area of the residual ink (and region of solid ink and region of dot ink) can be estimated based on the basis of the amount of ink jetted onto the transfer surface 10*a* (more specifically, the distribution of the discharge amount of ink onto the transfer surface 10*a*). According to the first method, the discharge amount may be actually acquired from each nozzle 213, or may be calculated based on information (tone distribution or the like) about image data used for image formation.

According to the second method, the inline sensor of the ink state detector 63 directly captures an image of residual ink. The area of the actually remaining ink can be accurately obtained in the second method, though it is necessary to provide an in-line sensor for obtaining area of the ink.

<Cleaning Processing>

Next, cleaning processing for performing the above-described cleaning operation will be described.

(First Aspect)

Figure 5:
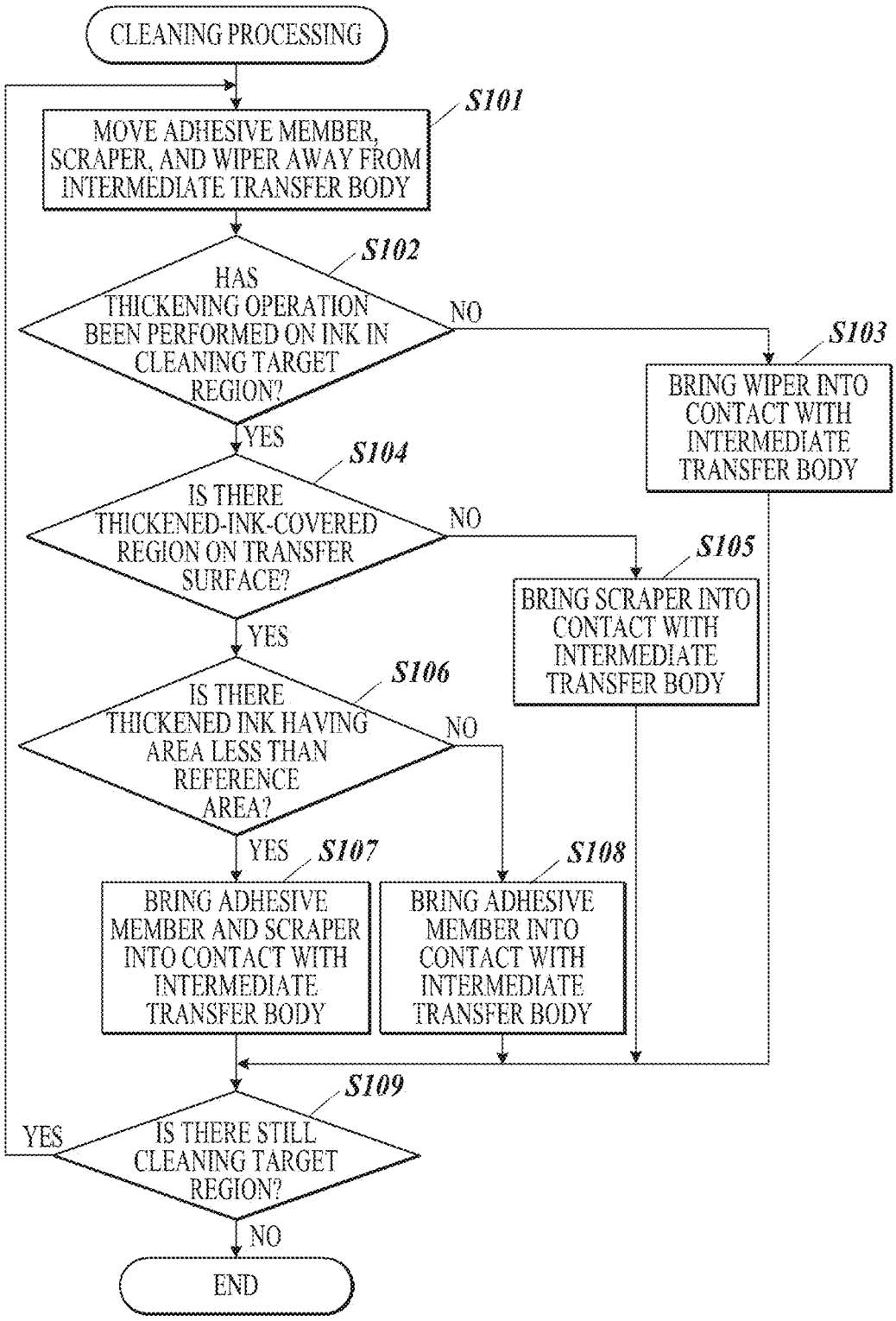
FIG. 5 is a flowchart showing a control procedure to perform cleaning processing according to First Aspect.

FIG. 5 is a flowchart showing a control procedure by the controller 5 to perform cleaning processing according to First Aspect.

Each time the ink forming a primary image on the intermediate transfer body 10 is transferred to the recording medium M, the cleaning processing may be performed in a region where the primary image has been formed. If a ratio of the residual ink is low or the residual ink does not stick to the next recording medium M, the cleaning processing may be performed after the primary image is transferred to the recording medium M a predetermined number of times or after the transfer operation is executed for a predetermined time.

Hereinafter, the region to be cleaned by the cleaner 4 in the transfer surface 10*a* of the intermediate transfer body 10 is referred to as a "cleaning target region."

When the cleaning processing is started, the controller 5 sends control signals to the adhesive member driver 412, the scraper driver 422 and the wiper driver 432 and moves the adhesive member 411, the scraper 421, and the wiper 431 to respective retracted positions so as to move them away from the transfer surface 10*a* of the intermediate transfer body 10 (step S101).

The controller 5 determines whether or not the first ultraviolet irradiator 61 has performed the thickening operation (ultraviolet irradiation) on the ink in the cleaning target region (step S102). If it is determined that the thickening operation has not been performed ("No" in step S102), the controller 5 determines that the residual ink is non-thickened ink, and causes the wiper 431 to be in contact with the intermediate transfer body 10 and to wipe the non-thickened ink (step S103).

When it is determined that the thickening operation is has been performed ("Yes" in step S102), the contoller 5 determines whether or not there is a thickened-ink-covered region on the transfer surface 10*a* (that is, whether or not there is solid ink having area larger than the reference area) by either of the two methods described above (Step S104). When it is determined that there is no thickened-ink-covered region ("No" in step S104), the controller 5 determines that the thickened ink is dot ink, and causes the scraper 421 to be in contact with the intermediate transfer body 10 and to remove the dot ink (step S105).

When it is determined that there is a thickened-ink-covered region ("Yes" in step S104), the contoller 5 determines whether or not there is thickened ink having area less than the reference area (step S106).

When it is determined that there is a thickened ink having area less than the reference area ("Yes" in step S106), the controller 5 determines that the thickened ink includes both dot ink and solid ink, causes the adhesive member 411 and the scraper 421 to be in contact with the intermediate transfer body 10 and to remove the thickened ink (Step S107).

When it is determined that there is not thickened ink having area less than the reference area ("No" in step S106), the controller 5 determines that the residual ink does not include solid ink but only dot ink and causes the scraper 421 to be in contact with the intermediate transfer body 10 and to remove the thickened ink (step S108).

When cleaning of the cleaning target region is finished through the process of step S103, S105, S107, or S108, the controller 5 determines whether or not there is still a cleaning target region (step S109). When it is determined that there is still a cleaning target region ("Yes" in step S109), the controller 5 returns to the process of step S101.

When it is determined that there is no longer a cleaning target region ("No" in step S109), the controller 5 finishes the cleaning processing.

(Second Aspect)

Next, cleaning processing according to Second Aspect will be described.

When the primary image is normally transferred to the recording medium M as usual, ink on the transfer surface 10*a* is provisionally cured in the thickening operation by the first ultraviolet irradiator 61, therefore, the residual ink becomes thickened ink. Based on such a premise, the determination may be omitted as to whether or not the thickening operation has been performed on the residual ink.

Figure 6:
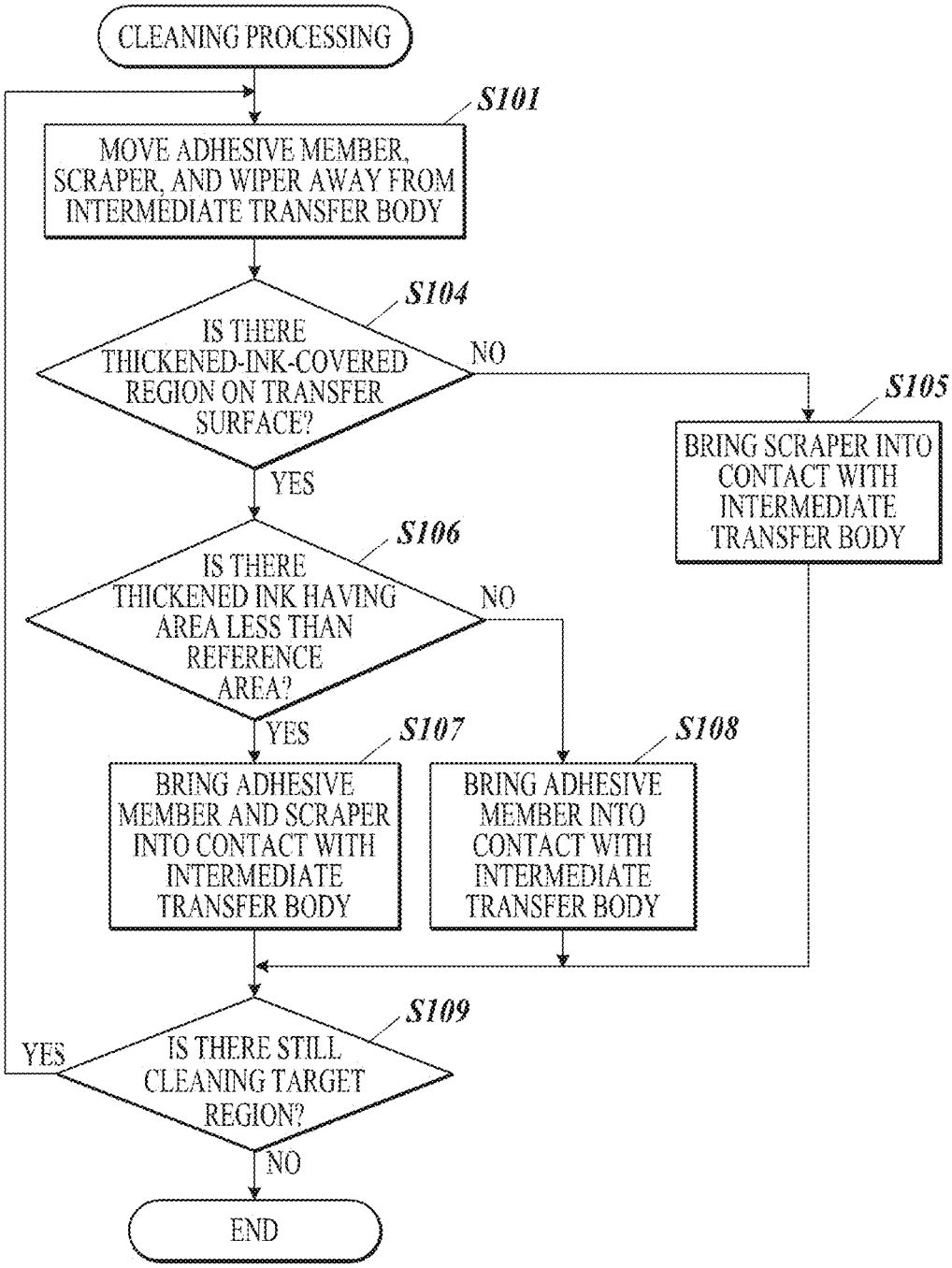
FIG. 6 is a flowchart showing a control procedure to perform cleaning processing according to Second Aspect.

FIG. 6 is a flowchart showing a control procedure by the controller 5 to perform cleaning processing according to Second Aspect.

The flowchart of FIG. 6 corresponds to one obtained by deleting the processes of steps S102 and S103 from the flowchart of FIG. 5. In this way, the member used for cleaning may be selected based only on the determination of whether or not there is a thickened-ink-covered region (step S104) and/or whether or not there is thickened ink having area less than the reference area (step S105).

(Third Aspect)

Next, cleaning processing according to Third Aspect will be described.

When the residual ink is thickened ink, the scraper 421 may perform the cleaning regardless of whether or not the thickened ink includes solid ink having area equal to or more than the reference area. As a result, the cleaning can be performed more effectively. For example, the scraper 421 can remove a part of the solid ink which has not been removed completely by the adhesive member 411.

Figure 7:
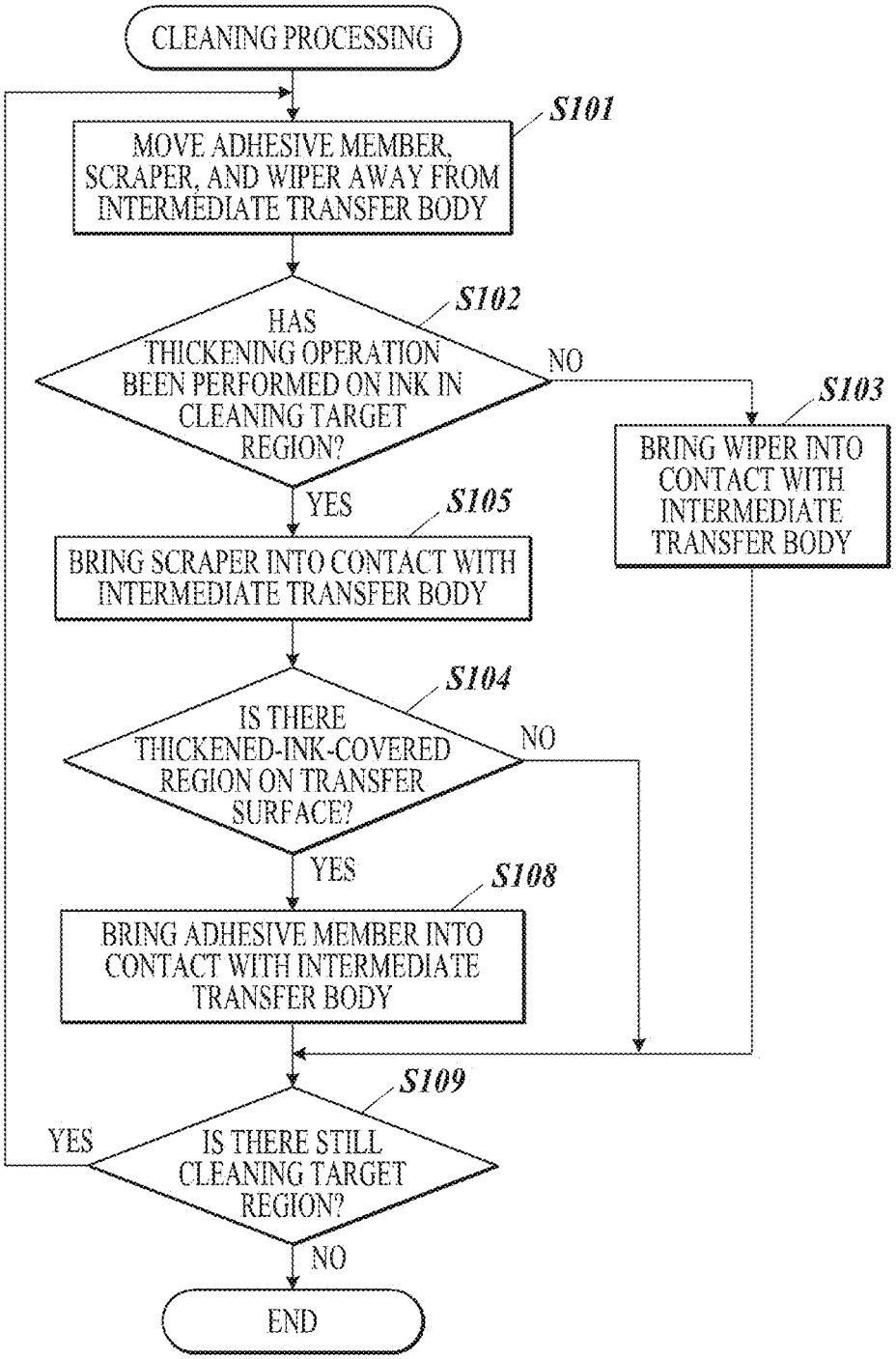
FIG. 7 is a flowchart showing a control procedure to perform cleaning processing according to Third Aspect.

FIG. 7 is a flowchart showing a control procedure by the controller 5 to perform cleaning processing according to Third Aspect.

The flowchart of FIG. 7 is the same as that of FIG. 5, except that the process of step S105 is performed after the process of step S102, the processes of steps S106 and S107 are deleted, and the like. Hereinafter, differences from the flowchart of FIG. 5 will be described.

In the cleaning processing of FIG. 7, when it is determined in the process of step S102 that the first ultraviolet irradiator 61 performs the thickening operation such that the residual ink is thickened ("Yes" in step S102), the controller 5 causes the scraper 421 to be in contact with the intermediate transfer body 10 (step S105).

The controller 5 determines whether or not there is a thickened-ink-covered region on the transfer surface 10*a* (step S104). When it is determined that there is a thickened-ink-covered region ("Yes" in step S104), the contoller 5 causes the adhesive member 411 to be contact with the intermediate transfer body 10 (step S108). Thereby, cleaning is performed with the adhesive member 411 and the scraper 421.

When it is determined that there is not a thickened-ink-covered region ("No" in step S104), the adhesive member 411 is not brought into contact with the intermediate transfer body 10, and cleaning is performed with the scraper only. When it is determined that there is not a thickened-ink-covered region ("No" in step S104) or when the process of step S108 is finished, the controller 5 performs the process of step S109 described above and determines whether or not there is still a cleaning target region.

(Fourth Aspect)

Next, cleaning processing according to Fourth Aspect will be described.

the cleaning processing according to Fourth Aspect is similar to the above Second Aspect in that determination in the above Third Aspect is omitted as to whether or not the thickening operation has been performed on the residual ink.

Figure 8:
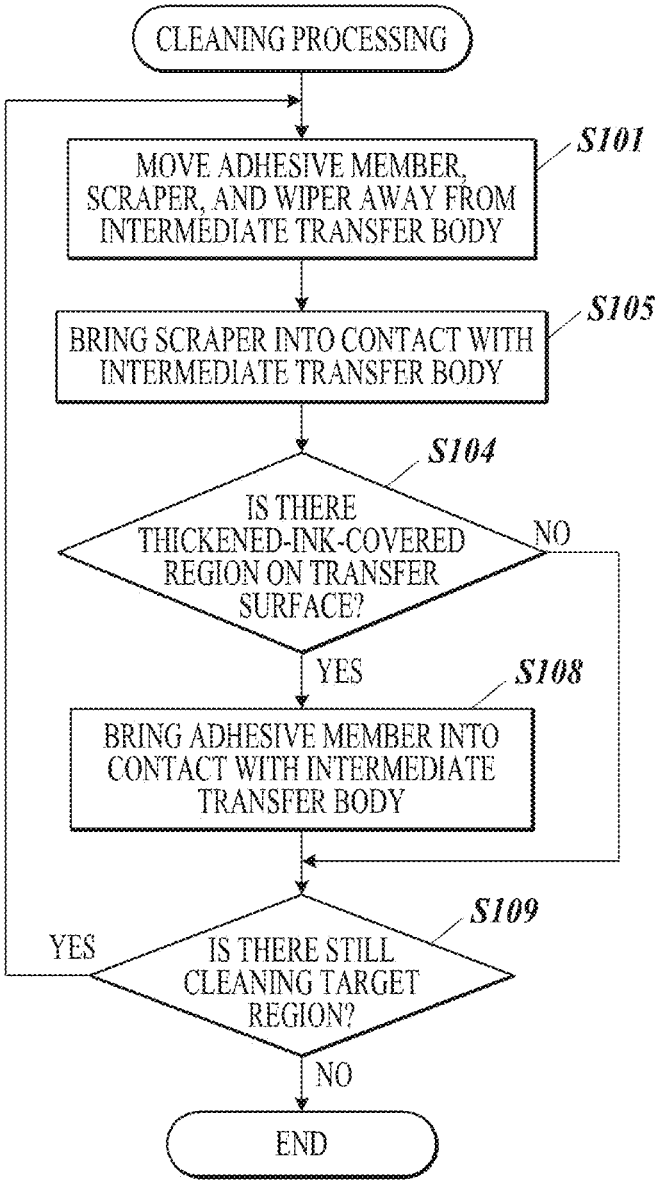
FIG. 8 is a flowchart showing a control procedure to perform cleaning processing according to Fourth Aspect.

FIG. 8 is a flowchart showing a control procedure by the controller 5 to perform cleaning processing according to Fourth Aspect.

The flowchart of FIG. 8 corresponds to one obtained by deleting the processes of steps S102 and S103 from the flowchart of FIG. 7. In this way, the member used for cleaning may be selected based only on the determination of whether or not there is a thickened-ink-covered region (step S104).

(Fifth Aspect)

Next, cleaning processing according to Fifth Aspect will be described.

The cleaning processing according to Fifth Aspect is performed in response to emergent stop of the image recording operation by the inkjet recording apparatus 1. The emergent stop is typically stop operation of respective units due to jamming of the recording medium M, but is not limited to this.

In response to emergent stop of the image recording operation, ink jetting of the head unit 21, circling movement of the intermediate transfer body 10, and the ultraviolet irradiation of the first ultraviolet irradiator 61 are stopped. Therefore, if the emergent stop is performed while the primary image on the transfer surface 10*a* is facing the first ultraviolet irradiator 61, the ink forming the primary image has been thickened on the downstream side of the facing position the first ultraviolet irradiator 61 in the circling direction, while it is not thickened on the upstream side of the facing position. This primary image is not usually transferred to the recording medium M because, even if it is transferred onto the recording medium M, a desired image cannot be obtained. Accordingly, all the ink forming the primary image is residual ink to be cleaned by the cleaner 4 and removed from the transfer surface 10*a*.

In this case, the cleaner 4 determines, in the cleaning target region (that is, the primary image forming region), a non-thickened portion Ina and a thickened portion Inb. The non-thickened portion Ina is residual ink including non-thickened ink, and the thickened portion Inb is residual ink except for the non-thickened portion Ina and composed of thickened ink.

Figure 9:
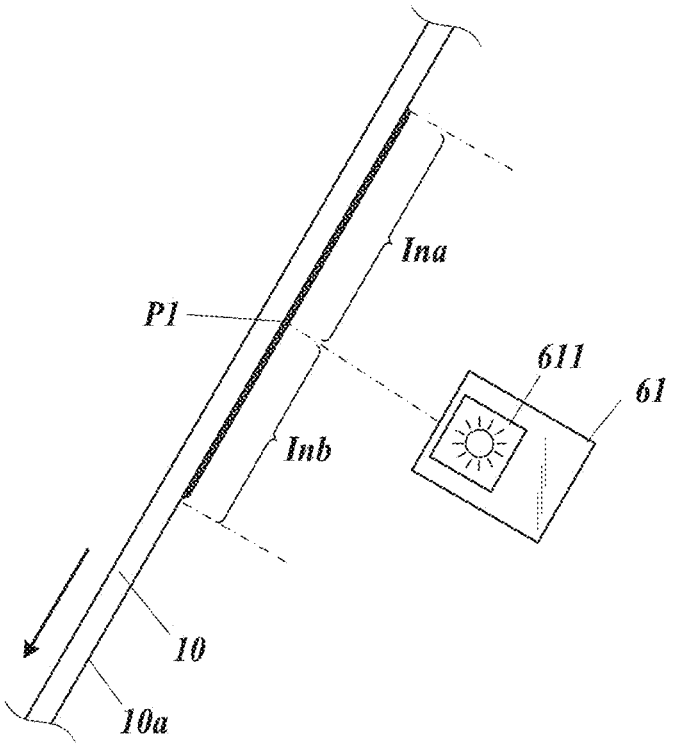
FIG. 9 is a diagram for explaining a first determination method of a non-thickened region and a thickened region.

FIG. 9 is a diagram for explaining a first determination method of the non-thickened region and the thickened region.

In the first determination method, a first position P1 on the transfer surface 10*a* is specified. The first position P1 is a position facing the ultraviolet source 611 of the first ultraviolet irradiator 61 when the intermediate transfer body 10 stops emergently. The ink on the upstream side of the first position P1 in the circling direction is determined to be the non-thickened portion Ina, and the ink on the downstream side of the first position P1 is determined to be the thickened portion Inb.

Figure 10:
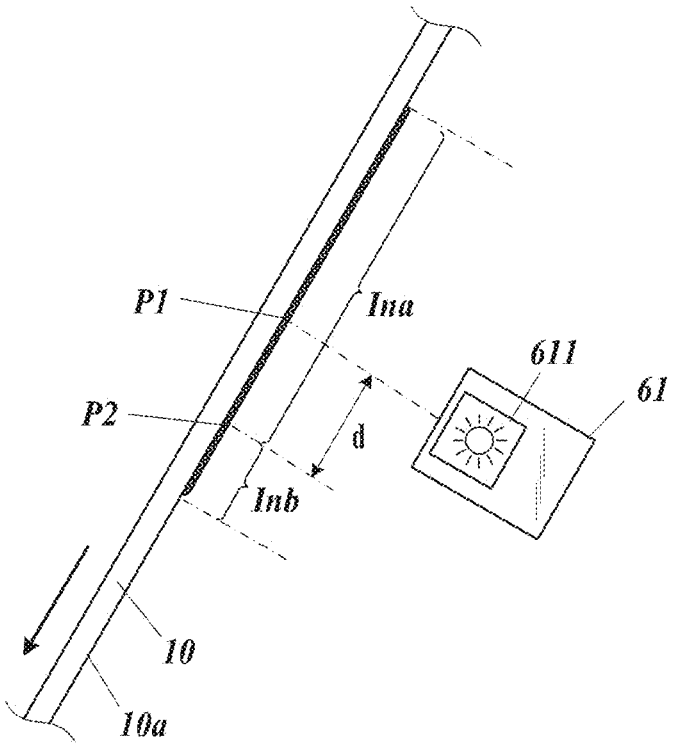
FIG. 10 is a diagram for explaining a second determination method of a non-thickened region and a thickened region.

FIG. 10 is a diagram for explaining a second determination method of the non-thickened region and the thickened region.

In response to the emergent stop of the image recording operation, while it is possible to immediately stop the ultraviolet irradiation of the first ultraviolet irradiator 61, it is difficult to immediately set the circling speed of the intermediate transfer body 10 to be zero. The intermediate transfer body 10 stops after moving slightly due to inertia (moment of inertia). In the second determination method, the non-thickened portion Ina and the thickened portion Inb are determined depending on the moving amount of the intermediate transfer body 10 due to the inertia. That is, the first position P1 faces the ultraviolet source 611 of the first ultraviolet irradiator 61 when the intermediate transfer body 10 is completely stopped, and the second position P2 is specified at a position on the downstream side of the first position P1 by a predetermined distance corresponding to the movement amount due to the inertia in the circling direction. The second position P2 corresponds to a position facing the first ultraviolet irradiator 61 when the first ultraviolet irradiator 61 stops the ultraviolet irradiation. Therefore, the ink on the upstream side of the first position P1 in the circling direction is determined to be the non-thickened portion Ina, and the ink on the downstream side of the first position P1 is determined to be the thickened portion Inb.

The wiper 431 performs cleaning of the non-thickened portion Ina determined as described above, and at least one of the adhesive member 411 and the scraper 421 selected according to area of the ink performs cleaning of the thickened portion Inb. Thus, residual ink can be effectively removed at the time of emergent stop.

Here, since it is desirable that the adhesive member 411 is not in contact with non-thickened ink, the adhesive member 411 is desirably in contact with the transfer surface 10*a* only until reaching a position away from the boundary between the non-thickened portion Ina and thickened portion Inb, by a predetermined distance toward the side of the thickened portion Inb. Thus, it is possible to suppress the occurrence of a problem that the adhesive force of the adhesive member 411 is reduced due to contact between the adhesive member 411 and non-thickened ink. In this case, because thickened ink may remain without being in contact with the adhesive member 411, the intermediate transfer body 10 may further circle after the cleaning target region has passed a position in front of the cleaner 4, so as to be cleaned again with the adhesive member 411 and the scraper 421. During this second cleaning, all the residual ink can be removed by the adhesive member 411 and the scraper 421 because all the residual ink is thickened as a result of ultraviolet irradiation by the first ultraviolet irradiator 61.

Figure 11:
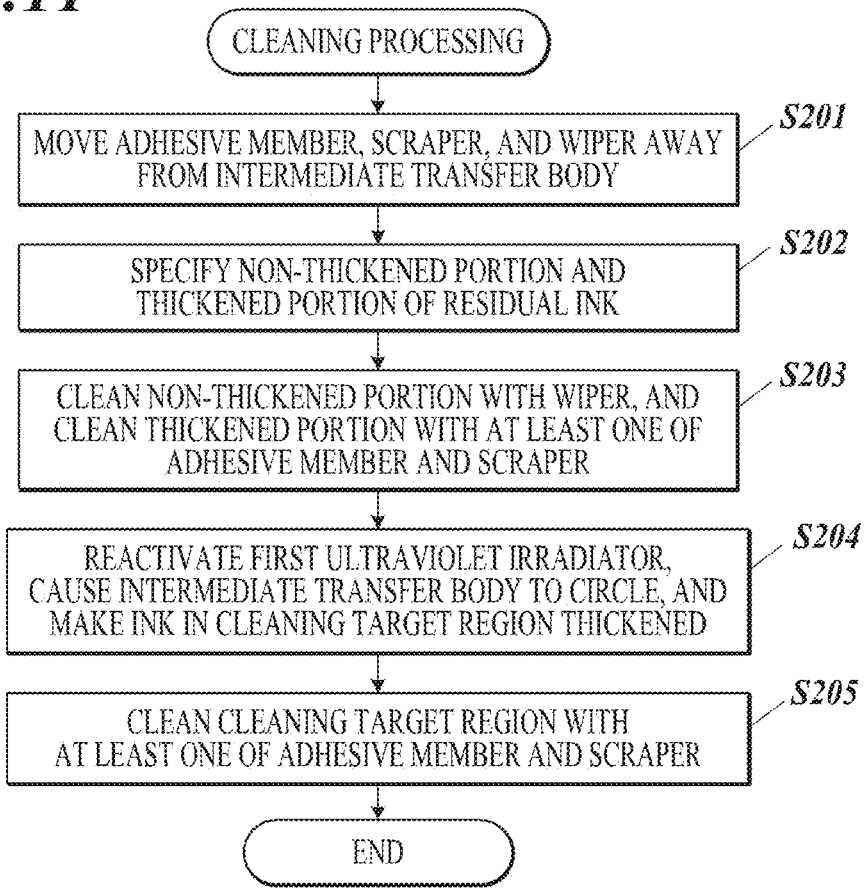
FIG. 11 is a flowchart showing a control procedure to perform cleaning processing according to a Fifth Aspect.

FIG. 11 is a flowchart showing a control procedure by the controller 5 to perform cleaning processing according to Fifth Aspect.

The cleaning processing according to Fifth Aspect is performed in response to the emergent stop of the image recording operation by the inkjet recording apparatus 1. When the cleaning processing is started, the controller 5 moves the adhesive member 411, the scraper 421, and the wiper 431 to respective retracted positions, that is, away from the transfer surface 10*a* of the intermediate transfer body 10 (step S201). The process of step S201 is performed in the same way as the process of the above step S101.

The controller 5 determines, using the first determination method or the second determination method described above, the non-thickened portion Ina and the thickened portion Inb in the cleaning target region (step S202).

The controller 5 causes the wiper 431 to perform cleaning for the non-thickened portion Ina and the adhesive member 411 and the scraper 421 to perform cleaning for the thickened portion Inb (step S203).

That is, while the non-thickened portion Ina passes the position facing the wiper 431, the controller 5 brings the wiper 431 into contact with the transfer surface 10*a* to wipe the non-thickened portion Ina.

The controller 5 brings the adhesive member 411 into contact with the transfer surface 10*a* while the thickened portion Inb passes the position facing the adhesive member 411, and the scraper 421 into contact with the transfer surface 10*a* while the thickened portion Inb passes the position facing the scraper 421. Then, the thickened ink of the thickened portion Inb can be removed by at least one of the adhesive member 411 and the scraper 421. The method for determining which of the adhesive member 411 and the scraper 421 is used is, for example, the method of steps S104 to S108 according to the cleaning procedure of First Aspect (FIG. 5) or the method of steps S105, S104, and S108 according to the cleaning procedure of Third Aspect (FIG. 7). The controller 5 controls the period when the adhesive member 411 is in contact with the transfer surface 10*a*, such that the adhesive member 411 is in contact with the transfer surface 10*a* only until reaching a position away from the boundary between the non-thickened portion Ina and thickened portion Inb by a predetermined distance toward the side of the thickened portion Inb.

The controller 5 reactivates the first ultraviolet irradiator 61 and moves the intermediate transfer body 10 around, so that the first ultraviolet irradiator 61 thickens the ink in the cleaning target region (step S204). Subsequently, the controller 5 causes at least one of the adhesive member 411 and the scraper 421 to clean the cleaning target area (step S205). In steps S204 and S205, non-thickened ink and thickened ink that could not be removed in the cleaning processes up to step S203 can be removed.

If residual ink can be removed in the processes up to step S203, the processes of steps S204 and S205 may be omitted.

After the step S205, the controller 5 finishes the cleaning processing.

(Sixth Aspect)

Next, cleaning processing according to Sixth Aspect will be described.

The cleaning processing according to Sixth Aspect is another aspect of cleaning processing in response to the emergent stop of the image recording operation by the inkjet recording apparatus 1.

In the cleaning processing according to Sixth Aspect, the controller 5 reactivates the first ultraviolet irradiator 61 and moves the intermediate transfer body 10 around, so that the first ultraviolet irradiator 61 thickens the ink in the cleaning target region. As a result, all the residual ink is thickened. Thereafter, at least one of the adhesive member 411 and the scraper 421 is selected depending on the area of the ink, and the thickened ink is removed. According to such a method, since it is not necessary to control the timing of switching between cleaning with the wiper 431 and cleaning with the adhesive member 411 or the scraper 421, cleaning processing can be performed simply. Furthermore, because cleaning processing to remove the non-thickened ink is not performed, it is possible to avoid reduction of adhesive force of the adhesive member 411 due to contact between the adhesive member 411 and non-thickened ink.

Figure 12:
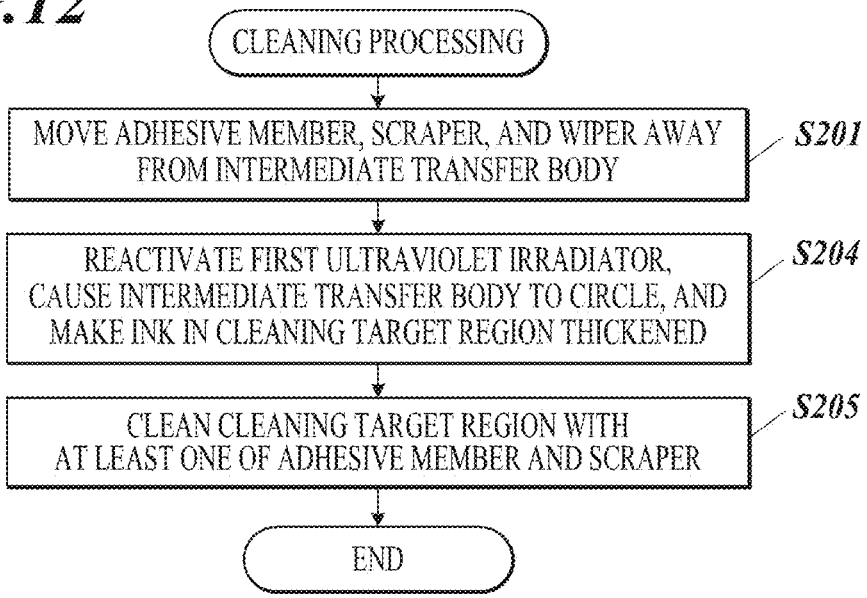
FIG. 12 is a flowchart showing a control procedure to perform cleaning processing according to a Sixth Aspect.

FIG. 12 is a flowchart showing a control procedure by the controller 5 to perform cleaning processing according to Sixth Aspect.

The flowchart of FIG. 12 corresponds to one obtained by deleting the processes of steps S202 and S203 from the flowchart of FIG. 11. Cleaning after an emergent stop can be also performed effectively according to such cleaning processing.

Modification 1

Next, Modification 1 of the above embodiment will be described.

Modification 1 is different from the above-described embodiment that the first ink remover 41 removes ink using an adhesive member. Hereinafter, the difference from the above embodiment will be mainly described.

Figure 13:
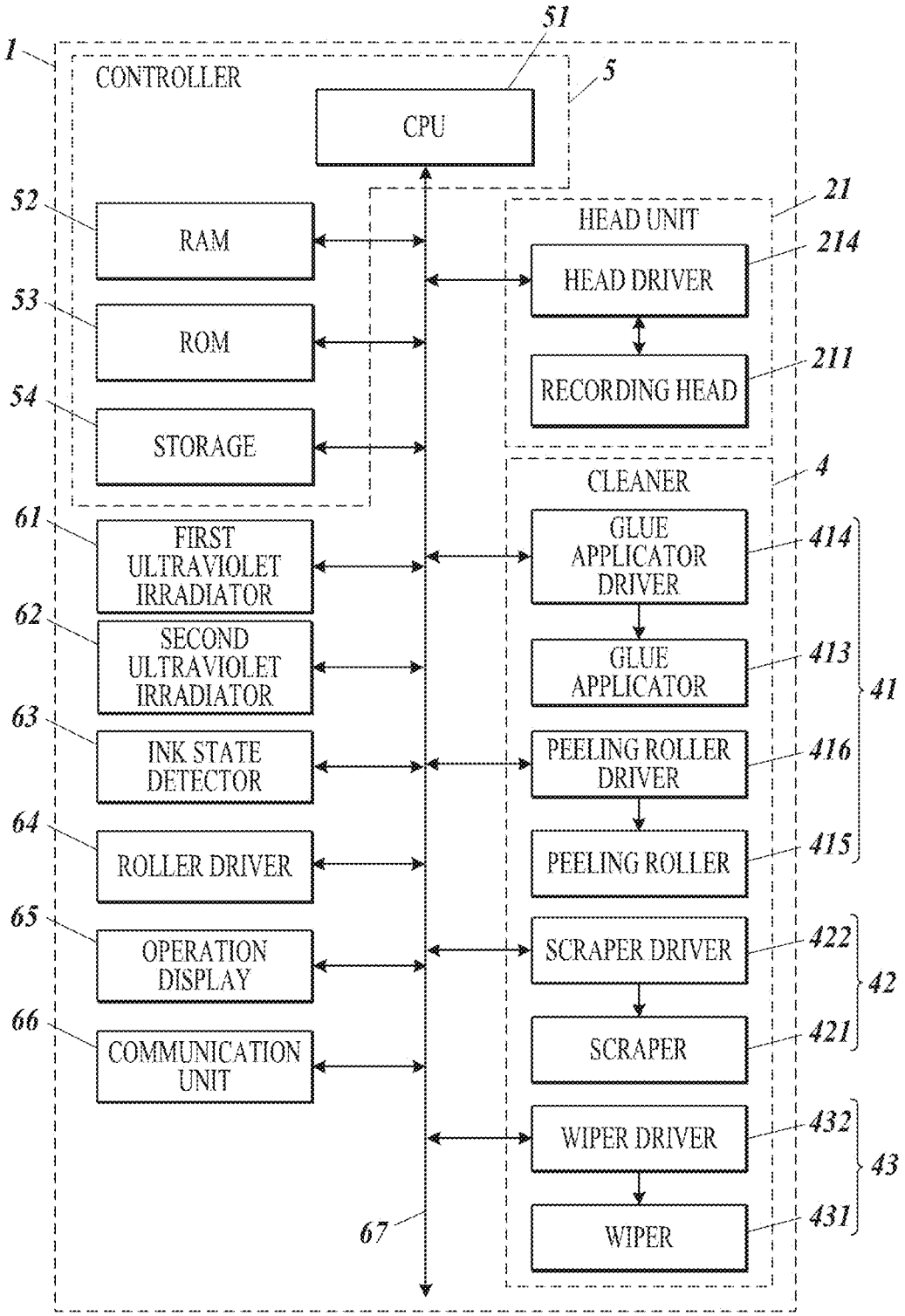
FIG. 13 is a block diagram showing functional configuration of an inkjet recording apparatus according to Modification 1.

FIG. 13 is a block diagram showing functional configuration of the inkjet recording apparatus 1 according to Modification 1.

The block diagram of FIG. 13 corresponds to one obtained by changing the configuration of the first ink remover 41 in the block diagram of FIG. 3.

The first ink remover 41 according to Modification 1 includes the followings: a glue applicator 413 (applicator) that applies glue as the adhesive member to the transfer surface 10*a*; a glue applicator driver 414 that drives the glue applicator 413 to apply the glue; a peeling roller 415 (peeling unit) that peels the glue off the transfer surface 10*a* (separates the glue from the transfer surface 10*a*) by rotating while the glue having applied to the transfer surface 10*a* sticks to the outer peripheral surface; and a peeling roller driver 416 that drives the peeling roller 415 to peel off the glue.

Figure 14A:
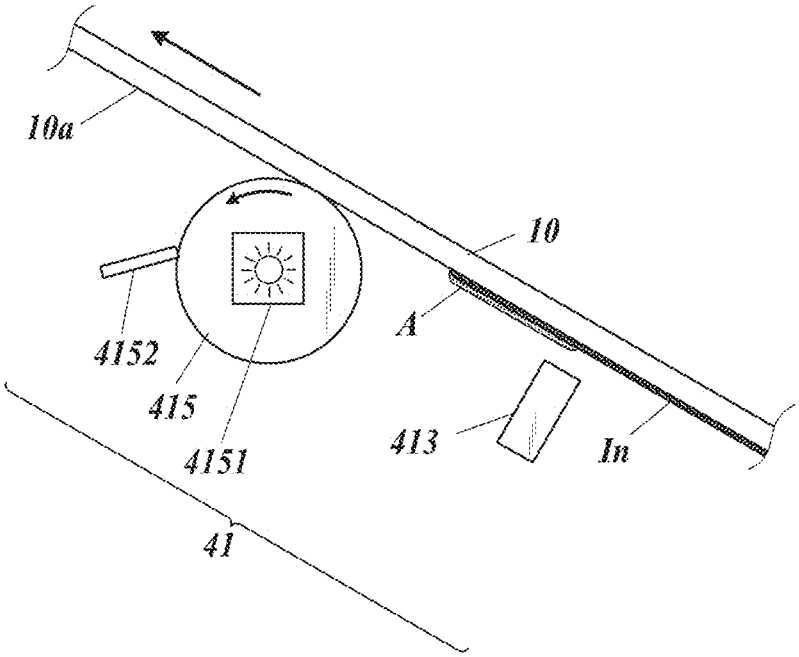
FIG. 14A is a diagram for explaining configuration and operation of a first ink remover according to Modification 1.
Figure 14B:
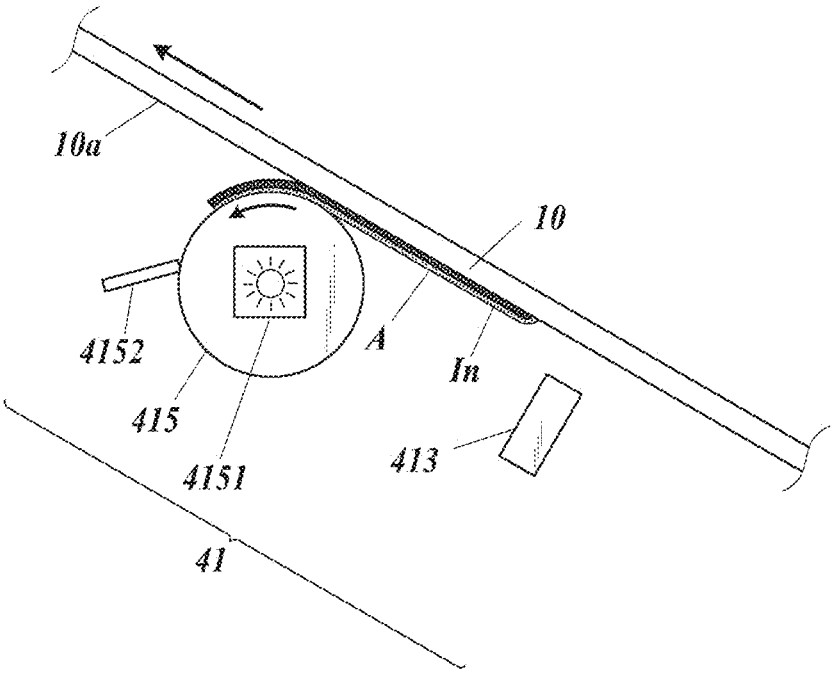
FIG. 14B is a diagram for explaining configuration and operation of the first ink remover according to Modification 1.

FIGS. 14A and 14B are diagrams for explaining the configuration and operation of the first ink remover 41 according to Modification 1.

As shown in FIG. 14A, the glue applicator 413 is provided so as to face the transfer surface 10*a*, so as to apply the glue A to any region of the circling transfer surface 10*a*. Specifically, the glue applicator 413 is driven by the glue applicator driver 414, and selectively applies the glue A to the region including solid ink, which is among the residual ink In (here, thickened ink) on the transfer surface 10*a* and occupying an area larger than the reference area. The method used for applying the glue A of the glue applicator 413 is not particularly limited, but may be an inkjet method in which a nozzle discharges droplets of glue, and the like.

The peeling roller 415 is a roller provided on the downstream side of the glue applicator 413 in the circling direction of the transfer surface 10*a*. The peeling roller 415 is movably provided between a contact position and a retracted position. While the peeling roller 415 is in contact with the transfer surface 10*a* when it is at the contact position, it is not in contact with the transfer surface 10*a* when it is at the retracted position. The peeling roller 415 is driven by the peeling roller driver 416 and moves between the contact position and the retracted position.

When in contact with the transfer surface 10*a* at the outer peripheral surface, the peeling roller 415 rotates depending on the circling movement of the transfer surface 10*a* because of the friction between the transfer surface 10*a* and the outer peripheral surface. The outer peripheral surface of the peeling roller 415 is made of a material to which the glue A sticks more easily than to the transfer surface 10*a*. Therefore, as shown in FIG. 14B, when the glue A passes through a nip between the transfer surface 10*a* and the outer peripheral surface of the peeling roller 415 in contact with the transfer surface 10*a*, not only the glue A on the transfer surface 10*a* but the residual ink on the transfer surface 10*a* sticks to the outer peripheral surface of the peeling roller 415 and is peeled from the transfer surface 10*a*.

The first ink remover 41 is also provided with a scraping member 4152 that removes the glue A and residual ink In sticking to the peeling roller 415.

The glue A is a photocurable liquid whose viscosity increases when irradiated with the second light whose wavelength intensity distribution has a peak within a predetermined wavelength range (in this embodiment, a liquid cured by ultraviolet rays). Inside the peeling roller 415 is provided an irradiator 4151 that irradiates the glue A with light (that is, ultraviolet rays) for curing the glue A. The part between the irradiator 4151 and an outer peripheral surface of the peeling rollers 415 is made of a material which transmits ultraviolet rays. With this configuration, the glue A on the transfer surface 10*a* can pass through the nip between the peeling roller 415 and the transfer surface 10*a* while being cured by the ultraviolet rays from the irradiator 4151. The glue A cured by the ultraviolet rays can be easily peeled off from the transfer surface 10*a* and can easily stick to the outer peripheral surface of the peeling roller 415. Therefore, the glue A does not remain on the transfer surface 10*a*, but can stick to the peeling roller 415 together with the residual ink.

Figure 15A:
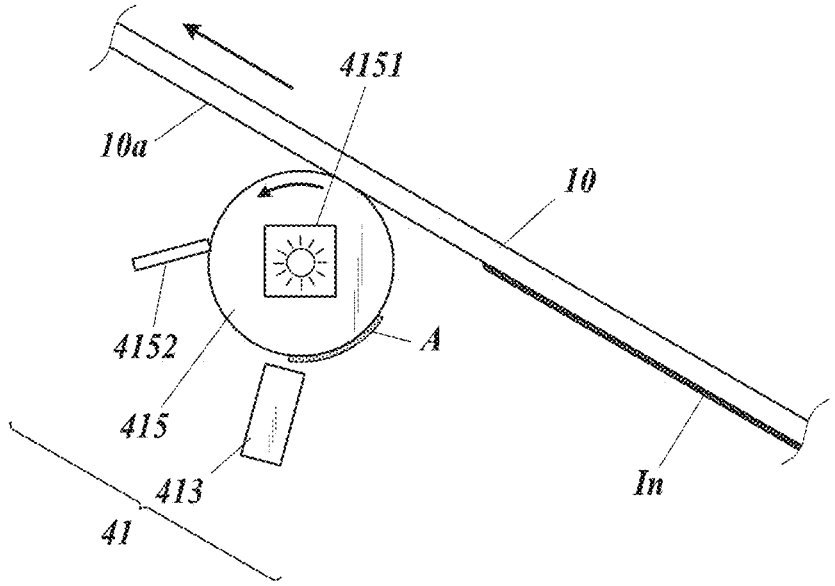
FIG. 15A is a diagram for explaining configuration and operation of another example of the first ink remover according to Modification 1.
Figure 15B:
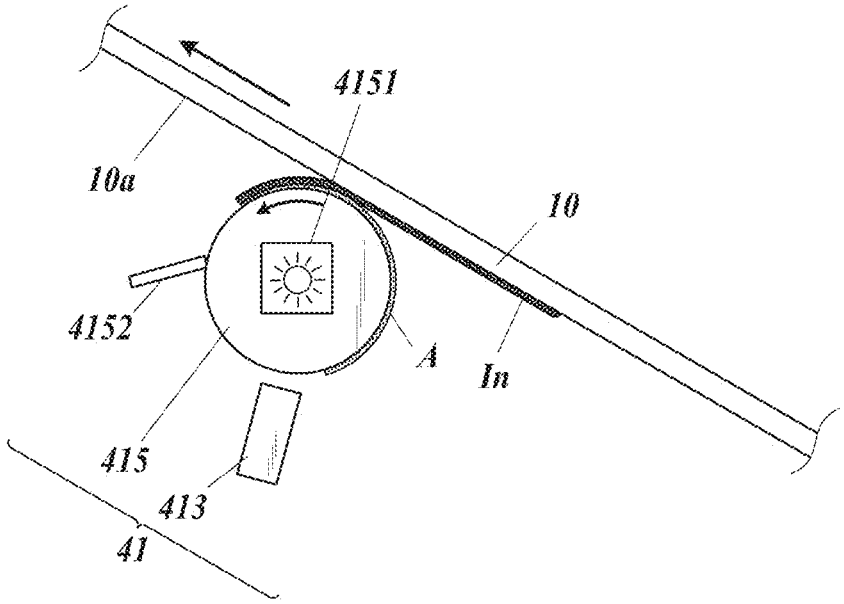
FIG. 15B is a diagram for explaining configuration and operation of another example of the first ink remover according to Modification 1.

FIGS. 15A and 15B are diagrams for explaining the configuration and operation of another example of the first ink remover 41 according to Modification 1.

As shown in FIG. 15A, the glue applicator 413 may be provided so as to apply the glue A to the outer peripheral surface of the peeling roller 415. With this configuration, the glue A on the outer peripheral surface of the peeling roller 415 and the residual ink In on the transfer surface 10*a* are pressure-bonded at the nip and stick to the outer peripheral surface of the peeling roller 415. As a result, the residual ink In is peeled off from the transfer surface 10*a*.

According to the first ink remover 41 having the configurations shown in FIG. 14A, FIG. 14B, FIG. 15A, and FIG. 15B, glue as the adhesive member is selectively brought into contact with an area where residual ink is present, so that the residual ink can be removed.

Figure 16:
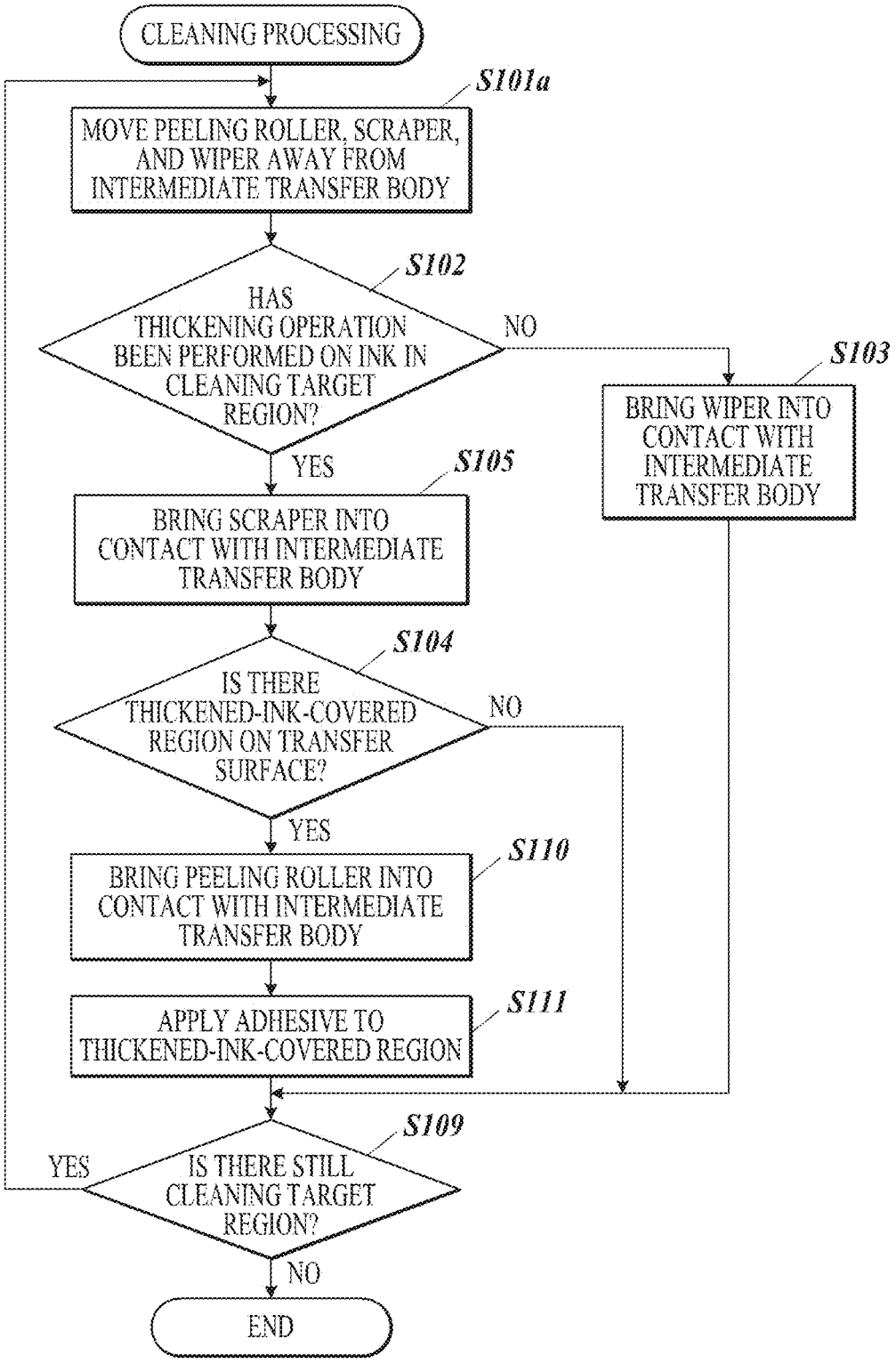
FIG. 16 is a flowchart showing a control procedure to perform cleaning processing according to Modification 1.

FIG. 16 is a flowchart showing a control procedure by the controller 5 to perform cleaning processing according to Modification 1.

The flowchart of FIG. 16 corresponds to one obtained by changing the process of step S101 in the flowchart of FIG. 7 (cleaning processing according to Third Aspect) is changed to step S101*a*, and changing the process of step S108 to processes of steps S110 to S111. Hereinafter, differences from the flowchart of FIG. 7 will be described.

When the cleaning processing is started, the controller 5 sends control signals to the peeling roller driver 416, the scraper driver 422, and the wiper driver 432 and moves the peeling roller 415, scraper 421, and the wiper 431 to respective retracted positions so as to move them away from the transfer surface 10*a* of the intermediate transfer body 10 (step S101*a*).

When it is determined in step S104 that there is a thickened-ink-covered region ("Yes" in step S104), the contoller 5 causes the peeling roller 415 to be in contact with the intermediate transfer body 10 (step S110). Furthermore, the controller 5 sends control signals to the glue applicator driver 414 and causes the glue applicator 413 to apply the glue A to the specified thickened-ink-covered region (that is, a region where the solid ink is present) (step S111). As a result, as described above, the glue A is applied onto the solid ink, sticks to the peeling roller 415 together with the residual ink depending on the circling movement of the transfer surface 10*a* and rotation of the peeling roller 415, peeled off from the transfer surface 10*a*, and removed.

After the step S111, the controller 5 performs the process of step S109 described above.

The cleaning processing according to Modification 1 may be obtained by changing the cleaning operation by the adhesive member 411 in the cleaning processing according to First Aspect, Second Aspect, and Fourth to Seventh Aspects described above to cleaning operation using the glue applicator 413 and the peeling roller 415.

Modification 2

Next, Modification 2 of the above embodiment will be described.

In the above embodiment, there has been described an example of cleaning performed when ink forming a primary image on the transfer surface 10*a* remains without being transferred. However, the present invention is not limited to this, and the target to be removed in the cleaning may be the ink jetted onto the transfer surface 10*a* for the purpose other than the formation of the primary image.

For example, during image forming operation of multiple primary images, ink that forms various patches on the transfer surface 10*a* for the purpose of stabilizing images may be removed in this way. Examples of the patches include a density patch of a predetermined density for detecting whether or not an image of an appropriate density is formed, a defect nozzle detection patch for detecting a defect nozzle that cannot perform ink jetting operation, and the like.

The inkjet recording apparatus 1 of the present embodiment which performs indirect printing using the intermediate transfer body 10 can perform density detection and defect nozzle determination on the intermediate transfer body 10 without transferring these patches on the transfer surface 10*a* to the recording medium M. Therefore, useless consumption of the recording medium M can be suppressed.

When detection or determination using the patch is completed, the ink forming the patch is removed by the cleaning unit 4. Since the patch is not transferred to the recording medium M, the thickening by the first ultraviolet irradiator 61 may or may not be performed. The inkjet recording apparatus 1 of this embodiment determines the thickening state with the above-described method, selects an appropriate cleaning member based on the determination result, and performs cleaning to effectively remove the patch.

As described above, the inkjet recording apparatus 1 of the present embodiment includes the ink jetter 2, the transfer unit 3, the first ultraviolet irradiator 61, the cleaner 4, and the controller 5. The ink jetter 2 jets ink. The transfer unit 3 has the intermediate transfer body 10 on which a primary image is formed by ink jetted from the ink jetter 2 and landing on a predetermined transfer surface 10*a*. The transfer unit 3 transfers the ink on the transfer surface 10*a* to the recording medium M and records an image on the recording medium M. The first ultraviolet irradiator 61 performs thickening operation in which viscosity of the ink landed on the transfer surface 10*a* is increased before transferred to the recording medium M. The cleaner 4 removes, from the transfer surface 10*a*, residual ink remaining on the transfer surface 10*a* without being transferred to the recording medium M.

The cleaner 4 has the first ink remover 41 that performs the first ink removing operation to remove the thickened ink, which is residual ink whose viscosity has been increased in the thickening operation, from the transfer surface 10*a* by moving the adhesive member 411 away from the transfer surface 10*a* after the adhesive member 411 having adhesive force is brought into contact with the residual ink. The controller 5 causes the first ink remover 41 to perform the first ink removing operation if there is a thickened-ink-covered region, which is the reference area or more and occupied by the thickened ink, on the transfer surface 10*a*.

With such configuration, if the residual ink includes solid ink that can be effectively removed by the adhesive member 411, cleaning can be performed using the adhesive member 411. As described above, since the adhesive member 411 does not easily lose adhesive force by being selectively used as needed, it possible to maintain high cleaning efficiency of the transfer surface 10*a*. Furthermore, since the adhesive member 411 is in contact with and peels off from the transfer surface 10*a* at a minimum required level, the adhering things do not easily drop from the surface of the adhesive member 411. Therefore, it is possible to suppress the occurrence of a problem that the peeled adhering things stain the transfer surface. This also makes it possible to maintain the high cleaning efficiency of the transfer surface 10*a*.

The cleaner 4 further includes the second ink remover 42 that performs the second ink removing operation to remove the residual ink from the transfer surface 10*a* by scraping it with the scraper 421. This makes it possible to efficiently remove, from the transfer surface 10*a*, the dot ink, whose area on the transfer surface 10*a* is less than the reference area, and a part of the solid ink which the adhesive member 411 could not completely remove. As a result, residual ink in various states can be effectively removed.

When the controller 5 determines that dot ink, whose area on the transfer surface 10*a* is less than the reference area, is present on the transfer surface 10*a*, the controller 5 causes the second ink remover 42 to perform the second ink removing operation. The scraper 421 thereby performs cleaning when the residual ink includes dot ink that can be effectively removed by the scraper 421. Because the scraper 421 can be prevented from being deteriorated by being selectively used when necessary, it possible to maintain high cleaning efficiency of the transfer surface 10*a*.

The cleaner 4 further includes the third ink remover 43 that performs the third ink removing operation to remove the residual ink from the transfer surface 10*a* by wiping it with the wiper 431. This makes it possible to efficiently clean the transfer surface 10*a* even when the residual ink includes non-thickened ink. As a result, residual ink in further various states can be effectively removed.

The inkjet recording apparatus 1 further includes a roller driver 64 that moves the transfer surface 10*a* relative to the first ultraviolet irradiator 61 and the cleaner 4 in a direction along the transfer surface 10*a*. The second ink remover 42 is provided on the downstream side of the first ink remover 41 in the moving direction of the transfer surface 10*a* with respect to the cleaner 4. The third ink remover 43 is provided on the downstream side of the second ink remover 42 in the moving direction. As the scraper 421 of the second ink remover 42 is provided on the downstream side of the adhesive member 411 of the first ink remover 41 in this way, the scraper 421 can remove the ink which the adhesive member 411 could not completely remove. Also, as the wiper 431 of the third ink remover 43 is provided on the downstream side of the scraper 421 of the second ink remover 42, when the scraper 421 includes a liquid containing a surfactant, the liquid can be wiped by the wiper 431.

If residual ink is non-thickened ink, the controller 5 causes the third ink remover 43 to perform the third ink removing operation, and the first ink remover 41 not to perform the first ink removing operation. As described above, since the wiper 431 is prevented from being deteriorated by being selectively used when necessary, it possible to maintain high cleaning efficiency of the transfer surface 10*a*. Furthermore, by causing the first ink remover 41 not to perform the first ink removing operation of the non-thickened ink, it is possible to suppress the occurrence of a problem that the adhesive force of the adhesive member 411 is lost at a portion whose surface the non-thickened ink is in contact with.

Furthermore, according to the above Fifth Aspect, if a part of the residual ink is the non-thickened portion Ina, which includes non-thickened ink, and if the residual ink other than the non-thickened portion Ina is the thickened portion Inb, which is composed of thickened ink, the controller 5 causes the third ink remover 43 to perform the third ink removing operation of the non-thickened portion Ina, and causes the first ink remover 41 to perform the first ink removing operation or the second ink remover 42 to perform the second ink removing operation of the thickened portion Inb. As a result, when there is residual ink including the non-thickened portion Ina and the thickened portion Inb on the transfer surface 10*a*, for example, in response to the emergent stop of the image recording operation, the transfer surface 10*a* can be cleaned efficiently and effectively.

Furthermore, according to the above Fifth Aspect, after finishing the third ink removing operation of the non-thickened portion Ina and at least one of the first ink removing operation and the second ink removing operation of the thickened portion Inb, the controller 5 causes the first ultraviolet irradiator 61 to perform thickening operation of the residual ink. The controller 5 further removes the thickened residual ink by at least one of the first ink removing operation by the first ink remover 41 and the second ink removing operation by the second ink remover 42. As a result, if the residual ink includes the non-thickened portion Ina, it is possible to remove ink on the transfer surface 10*a* using the adhesive member 411 and the scraper 421, while avoiding contact between the non-thickened ink with the adhesive member 411.

According to the above Sixth Aspect, when the residual ink includes non-thickened ink, the controller 5 performs thickening operation of the residual ink by the first ultraviolet irradiator 61, and further performs at least one of the first ink removing operation by the first ink remover 41 and the second ink removing operation by the second ink remover 42 of the thickened residual ink. As a result, if the residual ink includes non-thickened ink, it is possible to remove ink on the transfer surface 10*a* using the adhesive member 411 and the scraper 421, while avoiding contact between the non-thickened ink with the adhesive member 411.

Furthermore, the first ultraviolet irradiator 61 switchably performs or does not perform the thickening operation of the ink on the transfer surface 10*a* moving relative to and facing the first ultraviolet irradiator 61. On the basis of whether or not the thickening operation is performed while the ink on the transfer surface 10*a* is facing the first ultraviolet irradiator 61, the controller 5 determines whether or not each portion of the residual ink is thickened ink. As a result, it is possible to simply determine the thickening state of the ink based on whether or not the thickening operation is made.

Furthermore, the controller 5 determines whether or not there is a thickened-ink-covered region on the transfer surface 10*a* on the basis of an amount of ink jetted from the ink jetter 2 to the transfer surface 10*a*. As a result, it is possible to simply determine whether or not there is solid ink on the basis of the amount of jetted ink Furthermore, the inkjet recording apparatus 1 includes the ink state detector 63 that detects the ink on the transfer surface 10*a*, and the controller 5 determines whether or not there is a thickened-ink-covered region on the transfer surface 10*a* on the basis of the result of detection by the ink state detector 63. As a result, it is possible to more reliably determine whether or not there is solid ink.

Furthermore, the first ultraviolet irradiator 61 performs the thickening operation in which viscosity of the ink is increased to $1\times10^4$ Pa·s or more. As a result, it is possible to increase the viscosity such that the adhesive member 411 and the scraper 421 can effectively remove the ink.

Furthermore, the ink jetter 2 jets ink whose viscosity is increased in response to ultraviolet irradiation, and the ink on the transfer surface 10*a* is irradiated with ultraviolet rays in the thickening operation. As a result, it is possible to simply thicken ink using ultraviolet irradiation.

Furthermore, adhesive member 411 has adhesive force at the entire surface of a portion that can be in contact with the transfer surface 10*a*. As a result, it is possible to reduce ink that cannot be removed.

Furthermore, according to Modification 1, the first ink remover 41 is provided such that the adhesive member 411 can be in contact with any portion of the transfer surface 10*a*. As a result, the adhesive member 411 can be selectively brought into contact with the transfer surface 10*a* at a range where solid ink remains. This suppresses deterioration of the adhesive member 411 and peeling of the adhesive body more effectively, so that cleaning can be performed efficiently.

Furthermore, according to Modification 1, the adhesive member 411 is the glue A, and the first ink remover 41 includes the followings: the glue applicator 413 that applies the glue A to the transfer surface 10*a* in the range where the thickened ink is present; and the peeling roller 415 that peels the residual ink from the transfer surface 10*a* together with the glue A applied by the glue applicator 413. As a result, cleaning can be selectively performed in the range of the solid ink with the adhesive member. Therefore, the transfer surface 10*a* can be cleaned efficiently and effectively.

Furthermore, the glue A is a liquid whose viscosity is increased in response to ultraviolet irradiation, and the first ink remover 41 has the irradiator 4151 that irradiates the glue A applied by the glue applicator 413 with second light. The peeling roller 415 peels the glue A having increased viscosity as a result of the ultraviolet irradiation from the transfer surface 10*a*. As a result, the glue A can be easily peeled from the transfer surface 10*a*.

Furthermore, the peeling roller 415 having an outer peripheral surface that can be in contact with the transfer surface 10*a* and peels the glue A from the transfer surface 10*a* by rotating while the glue A is sticking to the outer peripheral surface. The irradiator 4151 is provided inside the peeling roller 415. The portion between the irradiator 4151 and the outer peripheral surface of the peeling roller 415 is made of a material that transmits ultraviolet rays. As a result, the configuration of the apparatus can be compact.

Furthermore, in the cleaning method of the intermediate transfer body 10 of the above embodiment, the first ink remover 41 performs the first removing operation when there is a thickened-ink-covered region on the transfer surface 10*a*. Therefore, the transfer surface 10*a* can be cleaned efficiently and effectively.

Although some embodiments according to the present invention have been described, the present invention is not limited to the above embodiments, and can be variously modified.

For example, the type of ink is not limited to the one that is cured by ultraviolet irradiation described in the above embodiment. For example, water-based ink including a coloring material, such as particles of a pigment, dispersed in water as a dispersion medium may be used. The water-based ink can be thickened by thermal energy added to the ink to vaporize the dispersion medium.

Furthermore, the reference area for determining solid ink and dot ink is not limited to be equal to the area of a circle having a diameter of 1 mm, but may be suitably set depending on the adhesive force of the adhesive member 411, the material of the scraper 421, the sticking force between the transfer surface 10*a* and the thickened ink, and the like.

Furthermore, the first ultraviolet irradiator 61 is not limited to be arranged at a position facing the outer peripheral surface of the intermediate transfer body 10. For example, the intermediate transfer body may be composed of an ultraviolet transmissive member, and the first ultraviolet irradiator 61 may be provided at a position facing the inner peripheral surface of the intermediate transfer body 10, such that the ink on the transfer surface 10*a* (outer peripheral surface) can be irradiated with ultraviolet rays from the inner peripheral surface through the intermediate transfer body 10. As a result of this, ink can be provisionally cured at the portion in contact with the transfer surface 10*a* and can be more easily peeled from the transfer surface 10*a*.

Furthermore, if ink is necessarily thickened before reaching the cleaner 4, the third ink remover 43 having the wiper 431 may be omitted.

Furthermore, the cleaner 4 may be provided with a blade made of an elastically deformable member such as urethane and rubber, to remove ink that could not be removed by the adhesive member 411, the scraper 421, or the wiper 431.

Furthermore, the intermediate transfer body 10 is not limited to an endless belt, and various members having a transfer surface on which ink lands may be used. For example, a cylindrical member whose shape is not deformed may be used as the intermediate transfer body 10.

Furthermore, in the above embodiments, an inkjet recording apparatus 1 of a single-pass system has been described as an example. However, the present invention may be applied to an inkjet recording apparatus that records an image while the recording head 211 performs a scan.

Although some embodiments of the present invention have been described and illustrated in detail, the disclosed embodiments are made for purposes of illustration and example only and not limitation. The scope of the present invention includes the scope of the present invention described in the scope of claims and the scope of their equivalents.

What is claimed is:

1. An inkjet recording apparatus comprising:

an ink jetter that jets ink;

a transfer unit that has an intermediate transfer body having a transfer surface on which ink jetted by the ink jetter lands and forms a primary image, transfers the ink on the transfer surface to a recording medium, and records an image on the recording medium;

a thickening device that performs thickening operation in which viscosity of the ink landed on the transfer surface is increased before transferred to the recording medium;

an ink state detector;

a cleaner that removes residual ink from the transfer surface, the residual ink remaining on the transfer surface without being transferred to a recording medium; and a hardware processor, wherein the cleaner has a first ink remover that removes thickened ink from the transfer surface in first ink removing operation in which an adhesive member having an adhesive force brought into contact with the thickened ink is separated from the transfer surface, the thickened ink being the residual ink whose viscosity has been increased in the thickening operation, and if the transfer surface has a thickened-ink-covered region that is a region occupied by the thickened ink and that has an area of a predetermined reference area or more, the hardware processor causes the first ink remover to perform the first ink removing operation via feedback from the ink state detector, wherein the thickening device increases viscosity of ink to $1\times10^4$ Pa·s or more in the thickening operation.

2. The inkjet recording apparatus according to claim 1, wherein the cleaner has a second ink remover that removes the residual ink from the transfer surface in second ink removing operation in which a scraper scrapes the residual ink.

3. The inkjet recording apparatus according to claim 2, wherein, if an area of the thickened ink on the transfer surface is less than the reference area, the hardware processor causes the second ink remover to perform the second ink removing operation.

4. The inkjet recording apparatus according to claim 2, wherein the cleaner has a third ink remover that removes the residual ink from the transfer surface in third ink removing operation in which a wiper wipes the residual ink.

5. The inkjet recording apparatus according to claim 4, further comprising:

a mover that moves the transfer surface with respect to the thickening device and the cleaner in a direction along the transfer surface, wherein the second ink remover is provided on a downstream side of the first ink remover in a moving direction of the transfer surface with respect to the cleaner, and the third ink remover is provided on a downstream side of the second ink remover in the moving direction.

6. The inkjet recording apparatus according to claim 4, wherein, if the residual ink is non-thickened ink whose viscosity is not increased in the thickening operation, the hardware processor causes:

the third ink remover to perform the third ink removing operation; and the first ink remover not to perform the first ink removing operation.

7. The inkjet recording apparatus according to claim 6, further comprising a mover that moves the transfer surface relative to the thickening device and the cleaner in a direction along the transfer surface, wherein the thickening device switchably performs or does not perform the thickening operation of the ink on the transfer surface moving relative to and facing the thickening device, and based on whether or not the thickening operation is performed while ink on the transfer surface faces the thickening device, the hardware processor determines whether or not each portion of the residual ink is thickened ink.

8. The inkjet recording apparatus according to claim 4, wherein, if a part of the residual ink is a non-thickened portion that includes non-thickened ink whose viscosity has not been increased in the thickening operation, and if the residual ink other than the non-thickened portion is a thickened portion whose viscosity has been increased, the hardware processor causes:

the third ink remover to perform the third ink removing operation of the non-thickened portion, and at least one of the first ink remover and the second ink remover to respectively perform the first ink removing operation and the second ink removing operation of the thickened portion.

9. The inkjet recording apparatus according to claim 8, wherein, in response to finishing the third ink removing operation of the non-thickened portion and at least one of the first ink removing operation and the second ink removing operation of the thickened portion, the hardware processor causes:

the thickening device to perform the thickening operation of the residual ink; and at least one of the first ink remover and the second ink remover to respectively perform the first ink removing operation and the second ink removing operation of the residual ink that is thickened in the thickening operation.

10. The inkjet recording apparatus according to claim 2, wherein, if the residual ink includes non-thickened ink whose viscosity is not increased in the thickening operation, the hardware processor causes:

the thickening device to perform the thickening operation of the residual ink; and at least one of the first ink remover and the second ink remover to respectively perform the first ink removing operation and the second ink removing operation of the residual ink that has been thickened in the thickening operation.

11. The inkjet recording apparatus according to claim 1, wherein, based on an amount of ink jetted from the ink jetter to the transfer surface, the hardware processor determines whether or not the thickened-ink-covered region is present on the transfer surface.

12. The inkjet recording apparatus according to claim 1, further comprising a detector that detects ink on the transfer surface, wherein, based on result of detection by the detector, the hardware processor determines whether or not the thickened-ink-covered region is present on the transfer surface.

13. The inkjet recording apparatus according to claim 1, wherein, the ink jetter jets ink whose viscosity is increased in response to irradiation with first light within a predetermined wavelength range, and the ink on the transfer surface is irradiated with the first light in the thickening operation.

14. The inkjet recording apparatus according to claim 1, wherein the adhesive member has the adhesive force at an entire surface of a portion that is contactable with the transfer surface.

15. The inkjet recording apparatus according to claim 1, wherein the first ink remover has the adhesive member that is contactable with any portion of the transfer surface.

16. The inkjet recording apparatus according to claim 15, wherein the adhesive member is glue, and the first ink remover includes:

an applicator that applies the glue to the transfer surface at a portion where the thickened ink is present: and a peeling unit that peels the thickened ink together with the glue applied by the applicator from the transfer surface.

17. The inkjet recording apparatus according to claim 16, wherein the glue is a liquid whose viscosity is increased in response to irradiation with second light within a predetermined wavelength range, the first ink remover has an irradiator that irradiates the glue applied by the applicator with the second light, and the peeling unit peels the glue whose viscosity is increased as a result of the irradiation with the second light from the transfer surface.

18. The inkjet recording apparatus according to claim 17, wherein the peeling unit is a roller that has an outer peripheral surface contactable with the transfer surface and peels the glue from the transfer surface by rotating while the glue sticks to the outer peripheral surface, the irradiator is provided inside the roller, and a portion between the irradiator and the outer peripheral surface of the roller is made of a material that transmits the second light.

19. A cleaning method of an intermediate transfer body in an inkjet recording apparatus, the inkjet recording apparatus including: an ink jetter that jets ink; a transfer unit that has an intermediate transfer body having a transfer surface on which ink jetted by the ink jetter lands and forms a primary image, transfers the ink on the transfer surface to a recording medium, and records an image on the recording medium; a thickening device that performs thickening operation in which viscosity of the ink landed on the transfer surface is increased before transferred to the recording medium; and a cleaner that removes residual ink from the transfer surface, the residual ink remaining on the transfer surface without being transferred to a recording medium, the cleaner having a first ink remover that removes thickened ink from the transfer surface in first ink removing operation in which an adhesive member having an adhesive force brought into contact with the thickened ink is separated from the transfer surface, the thickened ink being the residual ink whose viscosity has been increased in the thickening operation, the cleaning method comprising, if the transfer surface has a thickened-ink-covered region that is a region occupied by the thickened ink and that has an area of a predetermined reference area or more, causing the first ink remover to perform the first ink removing operation via feedback from the ink state detector, wherein the thickening device increases viscosity of ink to $1\times10^4$ Pa·s or more in the thickening operation.

* * * * *